US007427053B2

(12) United States Patent
Nawrocki

(10) Patent No.: US 7,427,053 B2
(45) Date of Patent: Sep. 23, 2008

(54) HOOK/HANGER COMPONENT MOUNTING SYSTEMS, COMPONENTS THEREOF, AND RELATED METHODS

(75) Inventor: John Richard Nawrocki, Ocala, FL (US)

(73) Assignee: Clairson, Inc., Newark, DE (US)

( * ) Notice: Subject to any disclaimer, the term of this patent is extended or adjusted under 35 U.S.C. 154(b) by 235 days.

(21) Appl. No.: 11/267,486

(22) Filed: Nov. 4, 2005

(65) Prior Publication Data

US 2007/0114348 A1 May 24, 2007

(51) Int. Cl.
*A47B 96/06* (2006.01)

(52) U.S. Cl. ..... 248/220.21; 248/220.31; 248/220.41; 248/302; 211/57.1

(58) Field of Classification Search ..... 248/220, 248/21, 220.31, 220.41, 220.42, 220.43, 248/221.11, 303, 302; 211/57.1, 59.1, 206
See application file for complete search history.

(56) References Cited

U.S. PATENT DOCUMENTS

| | | | | |
|---|---|---|---|---|
| 532,109 | A | | 1/1895 | Stinchcomb et al. |
| 844,459 | A | | 2/1907 | McCausland |
| 1,111,304 | A | | 9/1914 | Forester |
| 2,125,770 | A | | 8/1938 | Dabroski |
| 2,760,648 | A | | 8/1956 | Van Dusen |
| 2,841,353 | A | | 7/1958 | Burdick |
| 2,936,148 | A | | 5/1960 | Gralewicz |
| 3,037,733 | A | * | 6/1962 | Roman ..... 248/220.43 |
| 3,198,469 | A | | 8/1965 | Callanan |
| 3,229,823 | A | | 1/1966 | Hummer |
| 3,315,816 | A | | 4/1967 | Mallory |
| 3,409,260 | A | | 11/1968 | Bleed |
| 3,452,954 | A | | 7/1969 | Lucietta et al. |
| 3,495,718 | A | | 2/1970 | Romero |
| 3,516,634 | A | | 6/1970 | Salava et al. |
| 3,532,225 | A | | 10/1970 | Reed |
| 3,631,821 | A | | 1/1972 | Zachariou |
| 3,908,949 | A | | 9/1975 | Larson |
| 3,926,395 | A | * | 12/1975 | Lallement ..... 248/220.41 |
| 3,939,985 | A | | 2/1976 | Hochman |
| 3,985,325 | A | | 10/1976 | Ginsburg et al. |
| 4,026,508 | A | | 5/1977 | Ziegler |
| 4,094,415 | A | | 6/1978 | Larson |
| 4,098,480 | A | | 7/1978 | Neumann |
| 4,113,109 | A | | 9/1978 | Donnelli et al. |
| 4,151,917 | A | | 5/1979 | Pugh |

(Continued)

OTHER PUBLICATIONS

U.S. Appl. No. 60/434,470, filed Dec. 18, 2002, Costa et al.

(Continued)

*Primary Examiner*—Kimberly Wood
(74) *Attorney, Agent, or Firm*—Harness, Dickey & Pierce, P.L.C.

(57) ABSTRACT

Various aspects of the invention provide various embodiments of attachment members, hooks, hanger components, mounting systems and related methods. In one exemplary embodiment, a system generally includes a wall standard, a hanger component or component having at least two spaced-apart bar portions, and an attachment member engagable to the wall standard. The attachment member includes first and second recessed portions configured for trapping the corresponding spaced-apart bar portions between the wall standard and the attachment member when the attachment member is engaged to the wall standard. With this trapping, the attachment member can thus retain the hanger component to the wall standard.

14 Claims, 15 Drawing Sheets

U.S. PATENT DOCUMENTS

| | | | | |
|---|---|---|---|---|
| 4,191,110 | A | | 3/1980 | Klukos |
| 4,303,217 | A | | 12/1981 | Garfinkle |
| 4,316,547 | A | | 2/1982 | Varon |
| 4,387,872 | A | | 6/1983 | Hogue |
| 4,474,351 | A | | 10/1984 | Thalenfeld |
| 4,674,721 | A | | 6/1987 | Thalenfeld |
| 4,714,221 | A | | 12/1987 | Cawrey |
| 4,854,535 | A | | 8/1989 | Winter et al. |
| 4,869,376 | A | | 9/1989 | Valiulis et al. |
| 5,009,381 | A | | 4/1991 | Hermanson |
| 5,080,238 | A | | 1/1992 | Hochman |
| 5,082,125 | A | | 1/1992 | Ninni |
| 5,088,606 | A | | 2/1992 | Boas |
| 5,385,335 | A | | 1/1995 | Wurdack |
| 5,769,373 | A | * | 6/1998 | Bond ..... 248/220.41 |
| D406,485 | S | | 3/1999 | Paikos et al. |
| 5,934,636 | A | | 8/1999 | Cyrell |
| D416,471 | S | | 11/1999 | Wurdack |
| 5,975,318 | A | | 11/1999 | Jay |
| 6,059,124 | A | | 5/2000 | Weck et al. |
| 6,109,461 | A | | 8/2000 | Kluge et al. |
| 6,402,108 | B1 | | 6/2002 | Remmers |
| 6,489,566 | B1 | | 12/2002 | Durin |
| 6,497,395 | B1 | | 12/2002 | Croker |
| 6,502,706 | B1 | | 1/2003 | Kent |
| D495,588 | S | | 9/2004 | Wurdack |
| 6,811,043 | B2 | | 11/2004 | Perkins et al. |
| D550,540 | S | | 9/2007 | Nawrocki |
| D551,062 | S | | 9/2007 | Nawrocki |
| 2001/0013567 | A1 | | 8/2001 | Valiulis |
| 2002/0104938 | A1 | | 8/2002 | Simard |
| 2003/0057336 | A1 | | 3/2003 | Hochman |
| 2004/0144898 | A1 | | 7/2004 | Spagnoli |
| 2005/0011420 | A1 | | 1/2005 | Costa et al. |
| 2005/0145588 | A1 | | 7/2005 | Stitchick et al. |
| 2005/0150850 | A1 | | 7/2005 | Stitchick et al. |
| 2006/0067661 | A1 | | 3/2006 | Pierzynski et al. |
| 2007/0114348 | A1 | | 5/2007 | Nawrocki |
| 2007/0131683 | A1 | | 6/2007 | Sabounjian |

OTHER PUBLICATIONS 5 pages from http://lehighgroup.com, accessed on Dec. 26, 2005.

* cited by examiner

HOOK/HANGER COMPONENT MOUNTING SYSTEMS, COMPONENTS THEREOF, AND RELATED METHODS

FIELD

The present invention relates to the use of wall standards and tracks for mounting hooks and hanger components.

BACKGROUND

The statements in this background section merely provide background information related to the present disclosure and may not constitute prior art.

Wall standards can be used for mounting shelving brackets. Typical wall standards include relatively narrow strips that are mounted vertically against a wall using screws or other fasteners. Wall standards commonly include slots for receiving the tabs of a shelving bracket in order to thereby mount the bracket to the standard.

SUMMARY

According to various aspects of the invention, there are provided various exemplary embodiments of attachment members, hooks, hanger components, and mounting systems. In one exemplary embodiment, a system generally includes a wall standard, a hanger component or component having at least two spaced-apart bar portions, and an attachment member engagable to the wall standard. The attachment member includes first and second recessed portions configured for trapping the corresponding spaced-apart bar portions between the wall standard and the attachment member when the attachment member is engaged to the wall standard. With this trapping, the attachment member can thus retain the hanger component to the wall standard.

In another exemplary embodiment, a system generally in includes an apertured support surface, a hanger component having generally parallel spaced-apart crossbar portions, and an attachment member. The attachment member includes one or more tabs configured to be engaged within one or more apertures of the apertured support surface. The attachment member includes an upper portion and a lower portion. The upper portion includes a first recessed portion configured for trapping one of the crossbar portions between the apertured support surface and the attachment member. The lower portion includes a second recessed portion configured for trapping the other crossbar portion between the apertured support surface and the attachment member. With this trapping, the attachment member can thus retain the hanger component to the apertured support surface.

According to other aspects, the invention provides methods of mounting hanger components to apertured support surfaces. In one exemplary embodiment, a method generally includes positioning spaced-apart wire portions of a hanger component relative to spaced-apart recessed portions of an attachment member, and mounting the attachment member to the apertured support surface by engaging tabs of the attachment member with apertures of the apertured support surface such that the hanger component's spaced-apart wire portions are trapped between the apertured support surface and the recessed portions of the attachment member. With this trapping, the attachment member can thus retain the hanger component to the apertured support surface.

Further aspects and features of the present invention will become apparent from the detailed description provided hereinafter. In addition, any one or more aspects of the invention may be implemented individually or in any combination with any one or more of the other aspects of the invention. It should be understood that the detailed description and specific examples, while indicating exemplary embodiments of the invention, are intended for purposes of illustration only and are not intended to limit the scope of the invention.

DRAWINGS

The drawings described herein are for illustration purposes only and are not intended to limit the scope of the present disclosure in any way.

DETAILED DESCRIPTION

Figure 1:
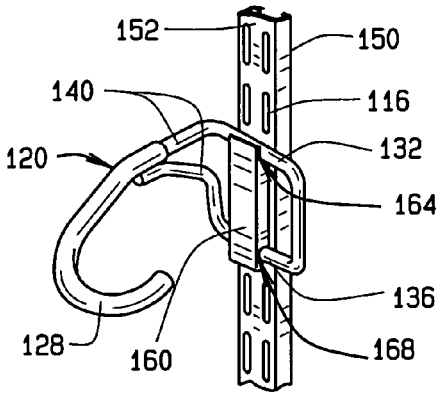
FIG. 1 is a perspective view showing a hanger component mounted to a wall standard with an attachment member according to one exemplary embodiment of the invention.

The following description is merely exemplary in nature and is in no way intended to limit the present disclosure, application, or uses.

According to various aspects, the invention provides various embodiments of attachment members, hooks, hanger components, and mounting systems capable of being assembled and mounted relatively easily and conveniently to support surfaces (e.g., apertured panels, wall standards, track standards, etc.), and, in some cases, even without using tools. Other aspects of the invention relate to methods of using and/or making such devices.

In one exemplary embodiment, a system generally includes a wall standard, a hanger component or component having at least two spaced-apart bar portions, and an attachment member engagable to the wall standard. The attachment member includes first and second recessed portions configured for trapping the corresponding spaced-apart bar portions between the wall standard and the attachment member when the attachment member is engaged to the wall standard. With this trapping, the attachment member can thus retain the hanger component to the wall standard.

In another exemplary embodiment, a system generally in includes an apertured support surface, a hanger component having generally parallel spaced-apart crossbar portions, and an attachment member. The attachment member includes one or more tabs configured to be engaged within one or more apertures of the apertured support surface. The attachment member includes an upper portion and a lower portion. The upper portion includes a first recessed portion configured for trapping one of the crossbar portions between the apertured support surface and the attachment member. The lower portion includes a second recessed portion configured for trapping the other crossbar portion between the apertured support surface and the attachment member. With this trapping, the attachment member can thus retain the hanger component to the apertured support surface.

According to other aspects, the invention provides methods of mounting hanger components to apertured support surfaces. In one exemplary embodiment, a method generally includes positioning spaced-apart wire portions of a hanger component relative to spaced-apart recessed portions of an attachment member, and mounting the attachment member to the apertured support surface by engaging tabs of the attachment member with apertures of the apertured support surface such that the hanger component's spaced-apart wire portions are trapped between the apertured support surface and the recessed portions of the attachment member. With this trapping, the attachment member can thus retain the hanger component to the apertured support surface.

According to other aspects of invention, there are provided various attachment members that can be used for mounting hooks or hanger components to apertured surfaces, such as double-slotted vertical wall standards, track standards, etc. In one specific embodiment, a bracket clip includes a channel having tabs that can be slidably inserted into the slots of a wall standard. The bracket clip, when engaged to the wall standard, can cooperate with the wall standard for pinching or trapping one or more wire portions of a hanger/hook component generally between the bracket clip and the wall standard, to thereby retain hanger/hook component to the wall standard.

In various embodiments, an attachment member includes at least one recessed portion (e.g., formed portion, notched portion, saddle, etc.) that together with the standard cooperatively traps at least one wire portion of a hook/hanger component between the attachment member and the standard, to thereby retain the wire portion against the wall standard. In one specific embodiment, a bracket clip creates a trapping saddle at the upper and lower portions of the bracket clip when the bracket clip is engaged to the standard. In such embodiment, the upper and lower trapping saddles of the bracket clip may clamp or wedge two spaced-apart bar portions of a hook/hanger component against and in contact the wall standard's front surface. Alternatively, the hanger component's spaced-apart bar portions may be trapped between a surfaces of the attachment member and the front surface of the standard, where the spaced-apart bar portions are generally against the standard. The attachment member can also include one or more tabs for engaging apertures (e.g., notches, slots, holes, etc.) in the wall standard, thereby allowing the hook or hanger component to be selectively positioned along the wall standard via the engagement of the attachment member without using any tools. In addition to reducing positional limits, this particular bracket clip can be used to readily and conveniently mount a hook or hanger component to a wall standard without having to use tools.

A wide range of materials can be used for a bracket clip. By way of example, various embodiments form the bracket clip or other attachment member from metals by stamping, roll forming, casting, among other suitable manufacturing process. Advantageously, the bracket clip in various embodiments can provides a unique way (without the need for tools) to install wire frame items to double-slotted wall standards, among other standards.

According to other aspects of the invention, there are provided various embodiments of hook or hanger components. In one specific embodiment, a hook/hanger component is produced of wire and can be wall-mounted for storage of articles, such as tools, cords, etc. Depending on the particular installation, the hook/hanger-component can be mounted to a wall, a stud, or other support surface by using mechanical fasteners, such as screws, bolts, etc. Or, for example, the hook/hanger component can be mounted to a double-slotted wall standard with a bracket clip or other suitable attachment device. In one specific embodiment, a bracket clip is provided that includes at least one void feature for trapping a forged-type mounting boss or coined feature of the hook/hanger component. The forged boss can also provide a land with a fastener hole for receiving a screw, bolt, or other suitable mechanical fastener useful for mounting the hook/hanger component to a wall, panel, or other support surface. In various embodiments, the back surface of the coined feature or boss may be substantially flat and flush with the tangent surface of the wire or bar portion. In such embodiments, this flat back surface of the boss can thus lie flush or abut against a corresponding flat support surface, e.g., a front surface of a wall standard, track, or wall, etc.

When a hook/hanger component is mounted to a standard with a bracket clip, the boss or coined feature can help inhibit the hook/hanger component from sliding side-to-side relative to the standard, as described and shown herein. In various embodiments, at least one portion of an attachment member (e.g., portions of a bracket, etc.) can fit or nest within the coining saddle of the hook/hanger component to maintain the vertical alignment of the hook/hanger component when installed to a standard.

In various embodiments, the installed product can be trimmed off with a push-on or push-fit cover that hides the mounting hardware (e.g., screws, boss feature, etc.). The trim cover can also provide a suitable surface for displaying indicia, such as one or more advertisements, trademarks, trade names, service marks, graphic images, graphic elements, designs, artwork, distinctive marks, identifying symbols, company logos, company contact information, text, alphanumeric characters, sports team insignias, names, monograms, photographs, among others. In some embodiments, the outer surface portion of the cover may include integrally formed (e.g., integrally molded, etched, carved, etc.) indicia thereon. Alternatively, the outer surface portion of the cover may simply provide an area that is conducive for printing and/or adhesively affixing a label thereto. Accordingly, various embodiments can provide an end product having an improved finished look, which can also accommodate company branding (or other indicia displaying) and find greater utility in more areas of the home, office, or other place of use.

Yet other aspects of the invention provide various embodiments of tracks or track standards capable of accommodating a wide range of hook/hanger components and bracket clips. In various embodiments, a track is fabricated by extrusion, rolling, stamping, composites, combinations thereof, etc. The track can be wall-mounted and provide utility for storage of articles, such as tools, sporting goods, etc. The track can be mounted to walls or other support surfaces by way of screws, bolts, other suitable fasteners, and other means.

When mounted to a generally vertical surfaces (e.g., wall stud, etc.), the track can include a channel that provides for ease of lateral adjustment and positioning to better accommodate storage of items. For example, one specific embodiment includes a carrier slidably mounted to the track's channel such that the carrier can be laterally moved along a length of the track. In this particular example, a hook/hanger component can be mounted to the slidably mounted carrier. In such embodiments, this unique mounting can thus allow the hook/hanger component to be readily repositioned by slidably moving the carrier along a length of the track channel, which may include grooves, races, depressions, etc. In some embodiments, the carrier can include slots for receiving tabs of a bracket clip to thereby allow the bracket clip (and the hook/hanger component) to be readily mounted to the carrier without the need of tools. One specific embodiment includes a track having a length of about thirty-six inches, and four carriers slidably mounted to the track.

Further aspects and features of the present invention will become apparent from the detailed description and drawings provided herein. In addition, any one or more aspects of the invention may be implemented individually or in any combination with any one or more of the other aspects of the invention.

Figure 2:
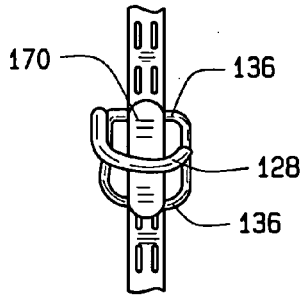
FIG. 2 is a front elevation view of the hanger component shown in FIG. 1 mounted to a wall standard with an attachment member according to another exemplary embodiment of the invention.

Referring now to FIGS. 1 and 2, there is shown one exemplary embodiment of a hook or hanger component 120 mountable to a wall standard or other support surface by an attachment member. As shown, the hanger component 120 generally includes wires 140 extending outwardly to form one or more end portions 128, which can be used for supporting one or more items thereon. The hanger component 120 also includes spaced-apart bar portions 132 and 136.

In one specific embodiment, the spaced-apart bar portions 132 and 136 of the hanger component 120 are adapted to be trapped between a wall standard 150 and an attachment member 160, which, in turn, is engagable to the wall standard 150. As shown in FIG. 1, the vertical wall standard 150 includes two columns of spaced-apart slots 116 disposed along the wall standard's front surface 152. While the wall standard 150 is illustrated with spaced-apart paired slots 116, other embodiments can be used with other types of wall standards having other opening arrangements or other means for engagement to such standards.

With further reference to FIGS. 1 and 2, the bar portions 132 and 136 are spaced apart from each other such that they may be positioned within the recessed portions 164 and 168 of the attachment member 160, which, in turn, may be engaged with the wall standard 150. The recessed portions 164 and 168 provide for trapping the respective bar portions 132 and 136 between the wall standard 150 and the attachment member 160 when the attachment member 160 is engaged to the wall standard 150. In some embodiments, the attachment member 160 may trap the bar portions 132 and 136 directly against the front surface 152 of the wall standard 150, although this is not required for all embodiments.

In various embodiments of a hanger component, the spaced-apart bar portions 132 and 136 of the hanger component 120 provide an opening therebetween that is adapted to generally receive an attachment member through the opening, thereby allowing the attachment member to engage a standard. The spaced-apart bar portions 132 and 136 can define an opening width that is sized relatively close to the size of the attachment member 160, such that vertical movement of the hanger component 120 relative to the attachment member 160 is inhibited or limited by the engagement between the attachment member 160 and the spaced-apart bar portions 132 and 136.

The hanger component 120 accordingly provides spaced-apart bar portions that may be operatively trapped by an attachment member (e.g., 160, etc.) against a standard (e.g., 150, etc.). The spaced-apart bar portions 132 and 136 can provide an opening through which an attachment member may engage the standard to trap the bar portions and inhibit movement of the hanger component 120 relative to the attachment member.

Figure 3:
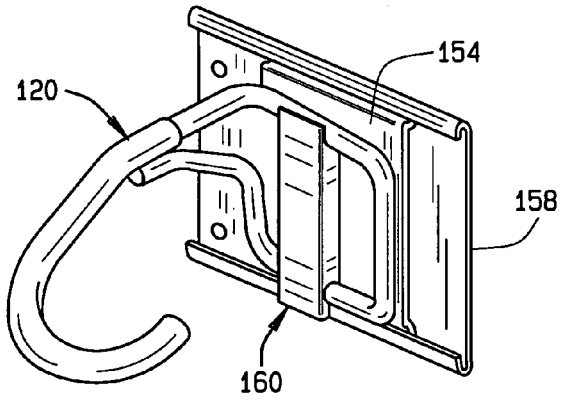
FIG. 3 is a perspective view of the hanger component and attachment member shown in FIG. 1 with the hanger component being mounted by the attachment member to a track standard according to another exemplary embodiment of the invention.
Figure 4:
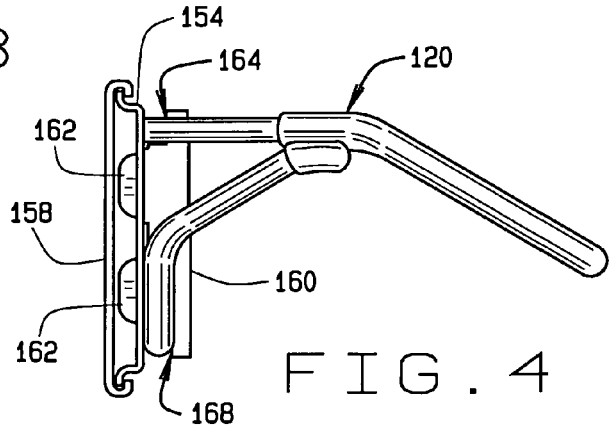
FIG. 4 is a side elevation view of the components shown in FIG. 3.

With reference now to FIGS. 3 and 4, the spaced-apart bar portions 132 and 136 of the hanger component 120 can alternatively, or additionally, be adapted to be trapped between an attachment member 160 and an apertured surface, such as a track mount or carrier 154, which, in turn, may be slidably received within a track standard 158. In this particular embodiment, the bar portions 132 and 136 can be sufficiently spaced apart from each other to allow the attachment member 160 (or at least a portion thereof, such as tabs 162 (FIG. 4), tabs 1362 (FIG. 28), tabs 1462 (FIG. 29), etc.) to be positioned generally between the bar portions 132 and 136 and then engaged with the track mount 154. As shown in FIGS. 3 and 4, the attachment member 160 may comprise recessed portions 164 and 168 that provide for respectively trapping the first and second bar portions 132 and 136 between the track mount 154 and the attachment member 160 when engaged to the track mount 154.

Figure 5:
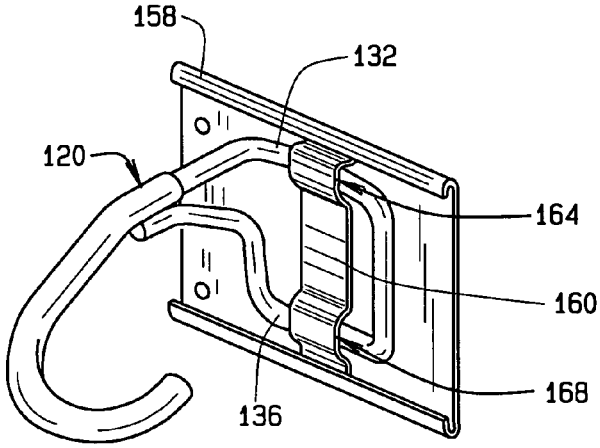
FIG. 5 is a perspective view of the hanger component shown in FIG. 3 mounted to the track standard with an attachment member according to another exemplary embodiment of the invention.
Figure 6:
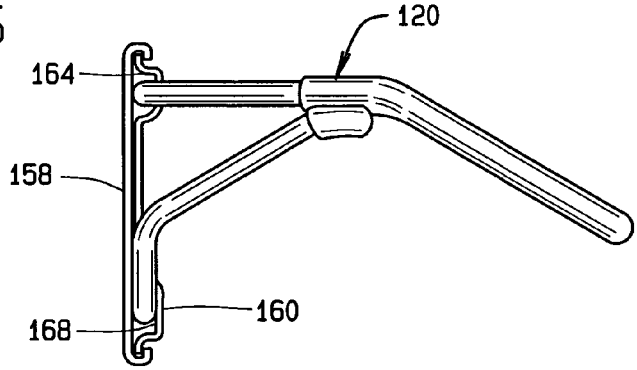
FIG. 6 is a side elevation view of the components shown in FIG. 5.

The at least two spaced-apart bar portions 132 and 136 of the hanger component 120 are also adapted to be trapped between an attachment member 160 and a vertical surface, such as a wall or a wall-mounted track standard 158 as shown in FIGS. 5 and 6. The first and second bar portions 132 and 136 can be sufficiently spaced apart from each other to allow the attachment member 160 (or at least a portion thereof) to be positioned generally between the bar portions 132 and 136 and then engaged with the track standard 158. The attachment member 160 may comprise recessed portions 164 and 168 that provide for trapping the first and second bar portions 132 and 136 between the track standard 158 and the attachment member 160 when engaged to the track standard 158.

In one embodiment of a hanger component 120, the hanger component 120 comprises a bar or rod 132 formed as shown in FIGS. 1 and 2 to include the bar portions 132 and 136. The bar portions 132 and 136 may be an integral part of a single bar that is monolithically formed to include the bar portions 132 and 136. In such embodiments, the bar portions 132 and 136 may comprise two generally parallel spaced-apart sections of the single monolithically formed bar.

The hanger component 120 further comprises one or more bar end portions 140 extending generally outwardly to form one or more end portions 128 from which one or more items may be hung. As shown in FIG. 1, the upper bar 132 extends outwardly and forms a generally curved hook portion 128 for supporting one or more items thereon. The bar portions 132 and 136 may be joined to each other by means of welding, thermal bonding, adhesives, locking joints, combinations thereof, among other suitable means for joining bar portions. Alternatively, the bar portions may be integrally made from a plastic material or other suitable material.

Figure 7:
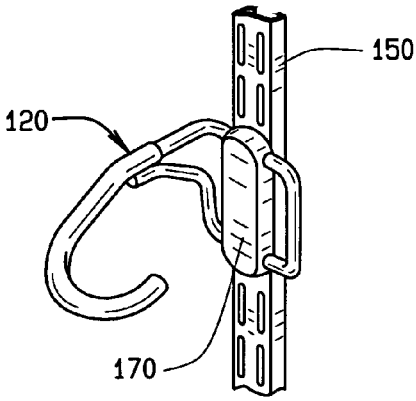
FIG. 7 is a perspective view of the hanger component shown in FIG. 1 mounted to the wall standard and further illustrating a cover device according to another exemplary embodiment of the invention.

In some embodiments, a cover member 170 (FIG. 7) is provided for covering the hanger component 120 and attachment member 160. The cover member 170 may be positioned over the attachment member 160 and/or over the bars of the hanger component 120. In various embodiments, the cover 170 comprises a push-on or push-fit cover that effectively hides the mounting hardware (e.g., screws, boss feature, etc.). The cover 170 can also provide a suitable surface for displaying indicia, such as one or more advertisements, trademarks, trade names, service marks, graphic images, graphic elements, designs, artwork, distinctive marks, identifying symbols, company logos, company contact information, text, alphanumeric characters, sports team insignias, names, monograms, photographs, among others. In some embodiments, the outer surface portion of the cover, may include integrally formed (e.g., integrally molded, etched, carved, etc.) indicia thereon. Alternatively, the outer surface portion of the cover may simply provide an area that is conducive for printing and/or adhesively affixing a label thereto. Accordingly, various embodiments can provide an end product having an improved finished look, which can also accommodate company branding (or other indicia displaying) and find greater utility in more areas of the home, office, or other place of use.

Figure 8:
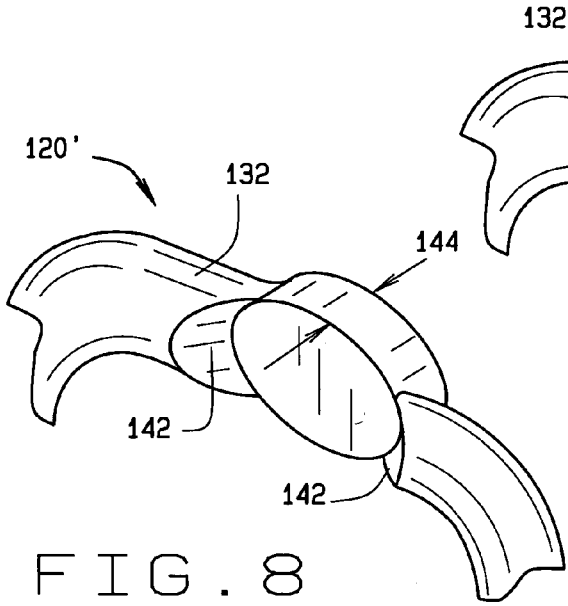
FIG. 8 is a perspective view of a portion of a hanger component having a tapered section and a reduced width portion according to another exemplary embodiment of the invention.

FIG. 8 illustrates an alternate embodiment of a hanger component 120'. As shown in FIG. 8, at least one of the two spaced-apart bar portions 132 and 136 may have a tapered section 142 and a reduced width portion 144. The reduced width portion 144 can be adapted to be received within a notched or recessed portion 164, 168 of an attachment member 160 for operatively trapping the hanger component's reduced width portion 144 against a standard when the attachment member 160 is engaged with the standard.

In one aspect, the tapered section 142, which leads into the hanger component's reduced width portion 144, can be configured to limit generally horizontal side-to-side movement of the hanger component 120 relative to the attachment member 160. Specifically, when an attachment member 160 is positioned to trap the reduced width portion 144 against a standard or other vertical surface, the tapered section 142 is inhibited from moving horizontally towards the attachment member 160 by virtue of the tapered section 142 being wider than the reduced width portion 144 received within a notch or recess 164 and 168 of the attachment member 160.

Figure 8A:
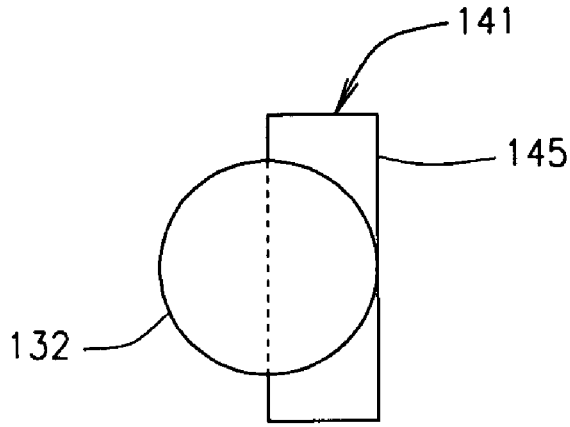
FIG. 8A is a partial side profile view of the boss or coined feature of the hanger component shown in FIG. 8 according to another exemplary embodiment of the invention.

As shown in FIG. 8A, the back surface 145 of the coined feature or boss 141 may be substantially flat and be substantially flush with the tangent surface of the wire or bar portion 132. In such embodiments, this flat back surface 145 of the boss or coined feature 141 can accordingly lie flush with and abut against a corresponding flat support surface, e.g., a front surface of a wall standard, track, or wall, etc.

Figure 9:
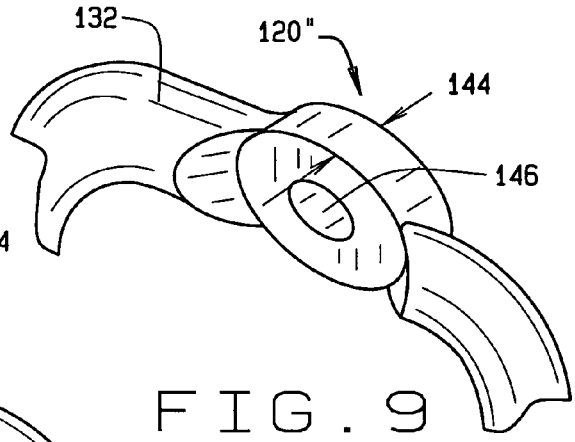
FIG. 9 is a perspective view of a portion of a hanger component having a tapered section, a reduced width portion, and a fastener hole according to another exemplary embodiment of the invention.

FIG. 9 illustrates another alternate embodiment of a hanger component 120". As shown in FIG. 9, one of the two spaced-apart bar portions 132 and 136 of the hanger component 120" may comprise a tapered section having a reduced width portion 144, which includes at least one opening 146 through the reduced width portion 144. The opening 146 is adapted to receive a fastener (e.g., fastener 248 shown in FIG. 14, etc.) to permit the hanger component 120" to be secured to a standard such that outward movement of the hanger component 120" relative to the standard is inhibited by the fastener (not shown).

In various embodiments, the spaced-apart bar portions 132 and 136 are adapted to receive a cover member 170 (FIG. 7) that may be positioned generally between the spaced-apart bar portions 132 and 136 of the hanger component 120", to provide for covering the hanger component 120" and fasteners. The cover member 170 may also be positioned generally between the spaced-apart bar portions 132 and 136 of the hanger component 120" and engaged directly to a standard.

Figure 9A:
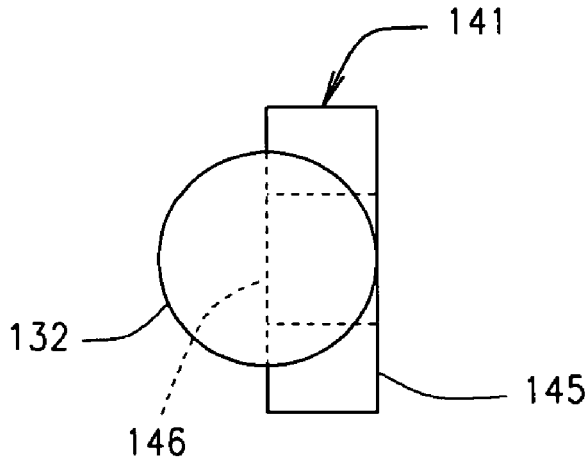
FIG. 9A is a partial side profile view of the boss or coined feature of the hanger component shown in FIG. 9 according to another exemplary embodiment of the invention.

As shown in FIG. 9A, the back surface 145 of the coined feature or boss 141 may be substantially flat and be substantially flush with the tangent surface of the wire or bar portion 132. In such embodiments, this flat back surface 145 of the boss or coined feature 141 can accordingly lie flush with and abut against a corresponding flat support surface, e.g., a front surface of a wall standard, track, or wall, etc.

Figure 10:
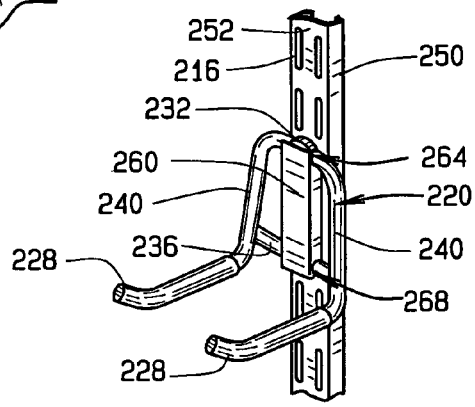
FIG. 10 is a perspective view showing a hanger component mounted to a wall standard with an attachment member according to another exemplary embodiment of the invention.

FIG. 10 illustrates another embodiment of a hanger component 220. As shown in FIG. 10, the hanger component 220 comprises a first bar 232 having opposing end portions 240 that generally extend downwardly and outwardly to form a pair of hooks or end portions 228 for supporting one or more items thereon. The hanger component 220 also includes a second crossbar portion 236 spaced apart from the first bar 232. The second crossbar portion 236 extends between the generally downwardly extending end portions 240 of the first bar portion 232. The second crossbar 236 contacts the downwardly extending end portions 240 of the first bar portion 232, and can be secured to the first bar 232 by means of welding, thermal bonding, adhesives, locking joints, or by other suitable means for joining two bar portions.

With continued reference to FIG. 10, the bar portions 232 and 236 of the hanger component 220 are adapted to be trapped between a wall standard 250 and an attachment member 260 engagable to the wall standard 250. The vertical wall standard 250 includes two columns of spaced-apart slots 216 disposed along the wall standard's front surface 252. Alternatively, other types of walls standards can be employed having other opening arrangements or other means for engagement.

The first and second bar portions 232 and 236 can be sufficiently spaced apart from each other to allow an attachment member 260 (or at least a portion thereof) to be positioned generally between the first and second bar portions 232 and 236 and engaged with the wall standard 250. The attachment member 260 may comprise recessed portions 264 and 268 that provide for trapping the first and second bar portions 232 and 236 between the wall standard 250 and the attachment member 260 when engaged to the wall standard 250. In some embodiments, the attachment member 260 may trap the bar portions 232 and 236 directly against the front surface 252 of the wall standard 250, although this is not required for all embodiments.

The two bar portions 232 and 236 can be spaced apart such that vertical movement of the hanger component 220 relative to an attachment member 260 positioned generally between the spaced-apart bar portions 232 and 236 is inhibited or limited by the spacing of the bar portions relative to the attachment member 260.

The bar portions 232 and 236 of the hanger component 220 may also be adapted to be trapped between an attachment member 260 and an apertured vertical surface, such as the track mount or carrier 154 slidably received within the track standard 158 as shown in FIGS. 3 and 4. In such embodiments, the first and second bar portions 232 and 236 can be sufficiently spaced apart from each other to allow the attachment member 260 (or at least a portion thereof) to be positioned between the bar portions 232 and 236 and engaged to the track mount or carrier 154. The attachment member 260 may comprise recessed portions 264 and 268 that provide for trapping the first and second bar portions between the track mount or carrier 154 and the attachment member 260 when the attachment member 260 is engaged to the track mount 154.

Figure 11:
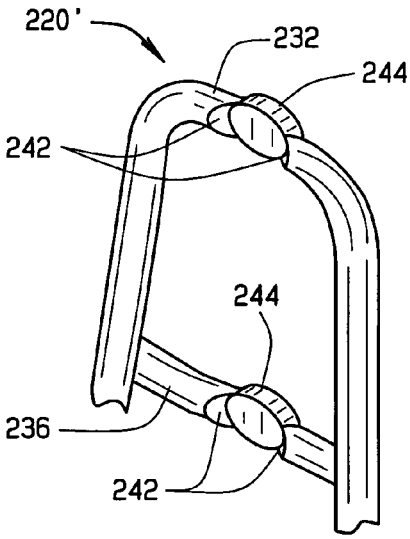
FIG. 11 is a perspective view of a portion of a hanger component having spaced-apart tapered sections and reduced width portions according to another exemplary embodiment of the invention.

FIG. 11 illustrates another alternate embodiment of a hanger component 220'. As shown in FIG. 11, each bar portions 232 and 236 comprises a tapered section 242 having a reduced width portion 244. The reduced width portions 244 are adapted to be received within recessed portions 264 and 268 of an attachment member 260 for trapping the reduced width portions 244 against a standard (or other support surface) when the attachment member 260 is engaged with the standard.

In some embodiments, the tapered sections 242 leading into the reduced width portions 244 can be configured to inhibit or limit horizontal side-to-side movement of the hanger component 220' relative to the attachment member 260. When an attachment member 260 is positioned to trap the reduced width portions 244 against a standard or other surface, the tapered sections 242 are inhibited from moving horizontally towards the attachment member 260 by virtue of the tapered sections 242 being wider than the reduced width portions 244 received within the attachment member's recesses 264, 268.

Figure 12:
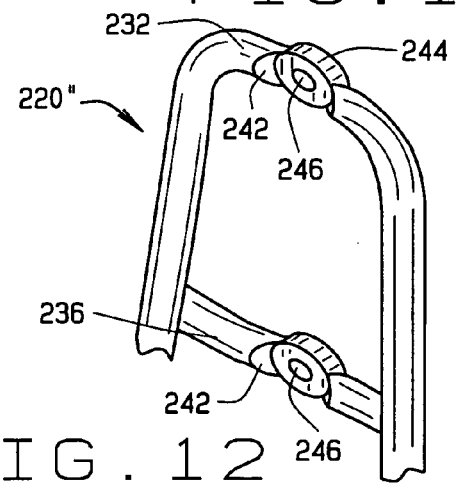
FIG. 12 is a perspective view of a portion of a hanger component having spaced-apart tapered sections, reduced width portions, and fastener holes according to another exemplary embodiment of the invention.

FIG. 12 illustrates another alternative embodiment of a hanger component 220". As shown in FIG. 12, the hanger component 220" comprises first and second spaced-apart bar portions 232 and 236. Each bar portion 232 and 236 has a tapered section 242 and a reduced width portion 244 with an opening 246 therethrough for receiving a fastener (e.g., 248 in FIG. 13, etc.).

The bar portions 232 and 236 may be sufficiently spaced apart from each other such that at least a portion of an attachment member (e.g., 260 in FIG. 10, etc.) may be positioned generally between the first and second bar portions 232 and 236 to engage a standard. In such embodiments, the attachment member 260 may comprise recessed portions 264 and 268 that provide for trapping the first and second bar portions 232 and 236 between the standard and the attachment member 260 when engaged to the standard.

Figure 13:
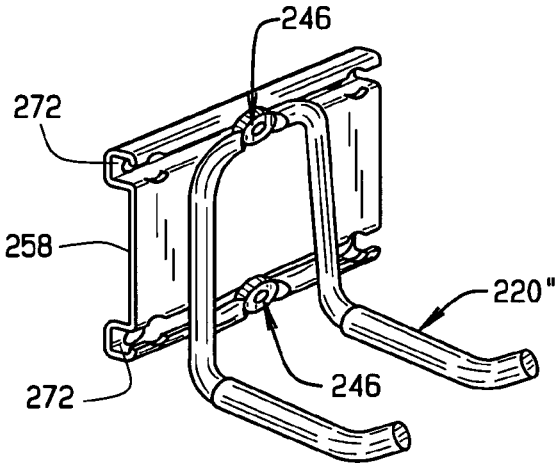
FIG. 13 is a perspective view showing a hanger component having the portion shown in FIG. 12 mounted to a track standard according to another exemplary embodiment of the invention.
Figure 14:
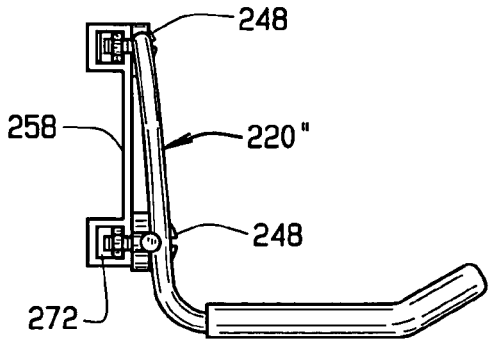
FIG. 14 is a side elevation view of the components shown in FIG. 13.

With reference now to FIGS. 13 and 14, the hanger component 220" may be slidably mounted to a track standard 258 by fasteners 248. The fasteners 248 may be slidably received within the longitudinal slots or channel 272 of the track standard 258.

As shown in FIGS. 13 and 14, each bar portion 232 and 236 of the hanger component 220" includes at least one opening 246 (FIG. 13) for receiving an attachment member or fastener 248 (FIG. 14). Accordingly, the hanger component 220" can be retained to the wall-mounted track standard 25 by the fasteners 248 received within the openings 246 and slots 272.

In some embodiments, the spaced-apart bar portions 232 and 236 of the hanger component 220" are adapted to accommodate a cover member that may be positioned generally between the spaced-apart bar portions 232 and 236, to provide for covering the hanger component 220" and attachment member 260 or fasteners 248 employed in retaining the hanger component 220" to the track standard 258. The cover member may be attached over an attachment member (e.g., 260 in FIG. 10), or may be positioned between the spaced-apart bar portions 232 and 236 of the hanger component 220" and then directly engaged with a standard or other support surface.

Figure 15:
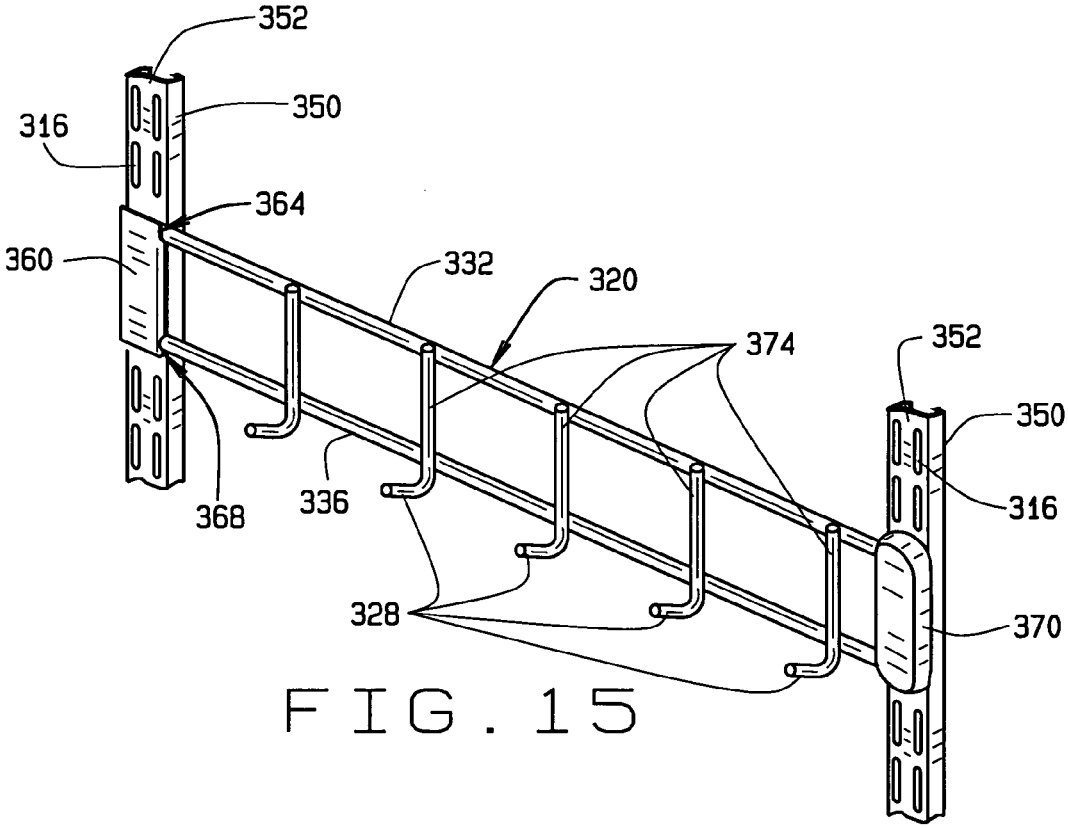
FIG. 15 is a perspective view showing a hanger component mounted generally between to wall standards with attachment members according to another exemplary embodiment of the invention.
Figure 16:
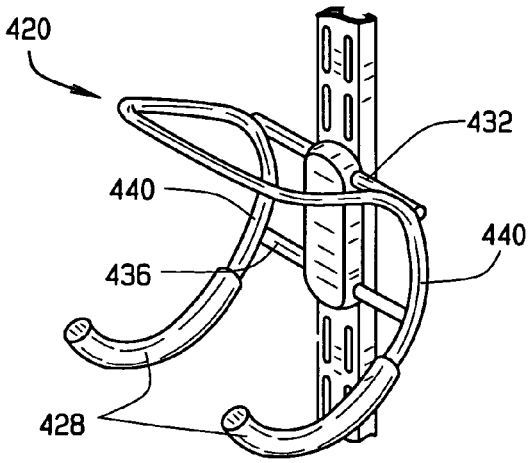
FIG. 16 is a perspective view showing a hanger component mounted to a wall standard with an attachment member according to another exemplary embodiment of the invention.
Figure 17:
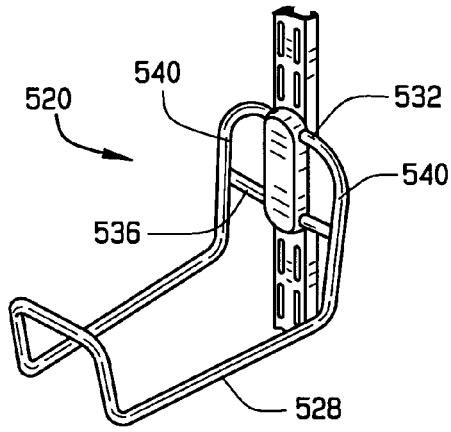
FIG. 17 is a perspective view showing a hanger component mounted to a wall standard with an attachment member according to another exemplary embodiment of the invention.
Figure 18:
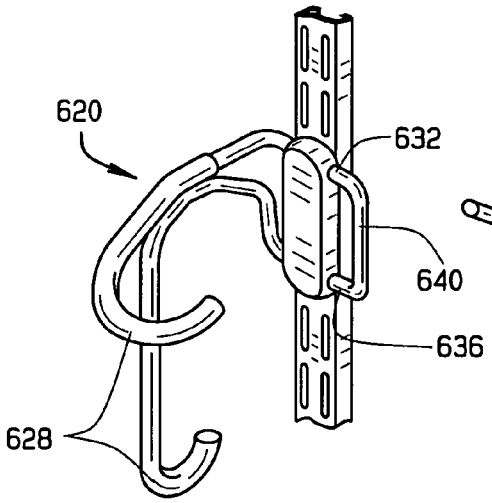
FIG. 18 is a perspective view showing a hanger component mounted to a wall standard with an attachment member according to another exemplary embodiment of the invention.
Figure 19:
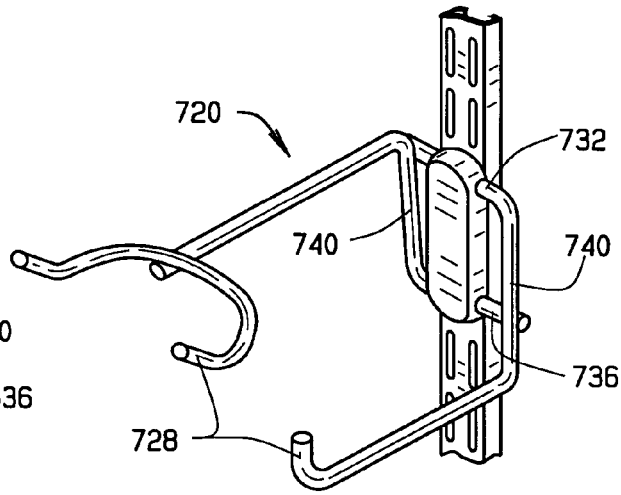
FIG. 19 is a perspective view showing a hanger component mounted to a wall standard with an attachment member according to another exemplary embodiment of the invention.
Figure 20:
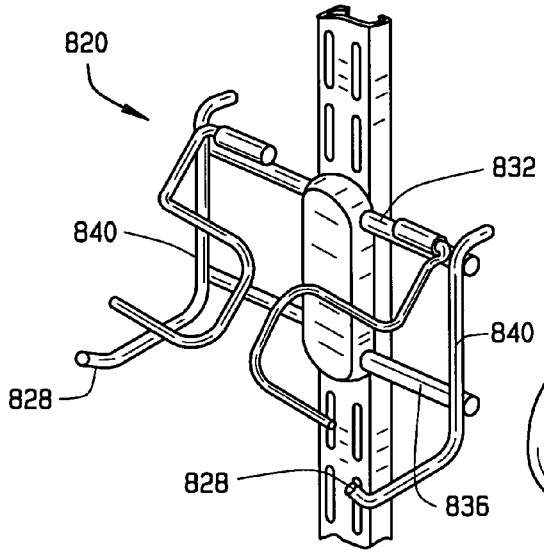
FIG. 20 is a perspective view showing a hanger component mounted to a wall standard with an attachment member according to another exemplary embodiment of the invention.

FIG. 15 illustrates another embodiment of a hanger component 320. As shown in FIG. 15, the hanger component 320 includes spaced-apart crossbar portions 332 and 336. The hanger component 320 is also shown with bar sections 374 extending outwardly to form hooks or end portions 328 for supporting items thereon.

In this particular embodiment, the crossbars 332 and 336 generally extend horizontally and parallel with one another. The crossbars 332 and 336 contact the downwardly extending wire sections 374. The crossbars 332 and 336 can be secured to the wire sections 374 by means of welding, thermal bonding, adhesives, locking joints, combinations thereof, among other suitable means for joining bar portions.

With continued reference to FIG. 15, the hanger component 320 is shown mounted generally between two wall standards 350. Alternative embodiments, however, can include hanger components mounted to more or less than two wall standards.

The crossbar portions 332 and 336 of the hanger component 320 are adapted to be trapped between a wall standard 350 and an attachment member 360 engagable to the wall standard 350.

The wall standards 350 shown in FIG. 15 include two columns of spaced-apart slots 316 disposed along the wall standard's front surface 352. Alternatively, the wall standards 350 may comprise other opening arrangements or means for engagement.

The first and second bar portions 332 and 336 can be sufficiently spaced apart from each other to allow an attachment member 360 (or at least a portion thereof) to be positioned generally between the first and second bar portions 332 and 336 for engaging the wall standard 350. The attachment member 360 may comprise recessed portions 364 and 368 that provide for trapping the first and second bar portions 332 and 336 between the wall standard 350 and the attachment member 360 when the attachment member 360 is engaged to the wall standard 350.

In various embodiments, the bar portions 332 and 336 of the hanger component 320 define an opening width therebetween that is sized relatively close to that of an attachment member 360 adapted to be received within the opening. With this relative sizing in such embodiments, the spaced-apart bar portions 332 and 336 can thus inhibit vertical movement of the hanger component 320 relative to the attachment member 360. In such embodiments, the hanger component 320 accordingly provides spaced-apart bar portions 332 and 336 that may be operatively trapped by an attachment member 360 against a standard, and the spaced-apart bar portions provide an opening through which an attachment member 360 may engage the standard to trap the bar portions 332 and 336 in a manner that inhibits movement of the hanger component 320 relative to the attachment member 360 and standard.

In some embodiments, a cover member 370 may be positioned over the attachment member 360 and/or over the bars of the hanger component 320. In various embodiments, the cover 370 comprises a push-on or push-fit cover that effectively hides the mounting hardware (e.g., screws, boss feature, etc.). The cover 370 can also provide a suitable surface for displaying indicia, such as one or more advertisements, trademarks, trade names, service marks, graphic images, graphic elements, designs, artwork, distinctive marks, identifying symbols, company logos, company contact information, text, alphanumeric characters, sports team insignias, names, monograms, photographs, among others. In some embodiments, the outer surface portion of the cover may include integrally formed (e.g., integrally molded, etched, carved, etc.) indicia thereon. Alternatively, the outer surface portion of the cover may simply provide an area that is conducive for printing and/or adhesively affixing a label thereto. Accordingly, various embodiments can provide an end product having an improved finished look, which can also accommodate company branding (or other indicia displaying) and find greater utility in more areas of the home, office, or other place of use.

FIGS. 16 through 20 respectively illustrate various alternative embodiments 420, 520, 620, 720, and 820 of a hanger component. As shown in these figures, the various hanger components 420, 520, 620, 720, 820 generally include various configurations of formed wire and bar end portions 440, 540, 640, 740, 840 to provide one or more end portions 428, 528, 628, 728, 828 for supporting one or more items thereon. These various embodiments of the hanger component also include spaced-apart bar portions 432, 436, 532, 536, 632, 636, 732, 736, 832, 836. As described and shown herein, these spaced-apart bar portions can allow the hanger component to be mounted with an attachment member to a wall standard or other support surface, for example, by the attachment member trapping the spaced-apart bar portions against the wall standard's front surface and/or generally between the wall standard's front surface and the attachment member.

In still other embodiments of the invention, a hanger component may comprise or include a support for a shelf, or alternatively may include a shelf portion. For example, FIG. 21 illustrates an exemplary embodiment of a hanger component 920 having bars or wires 974 forming a shelf portion.

Figure 21:
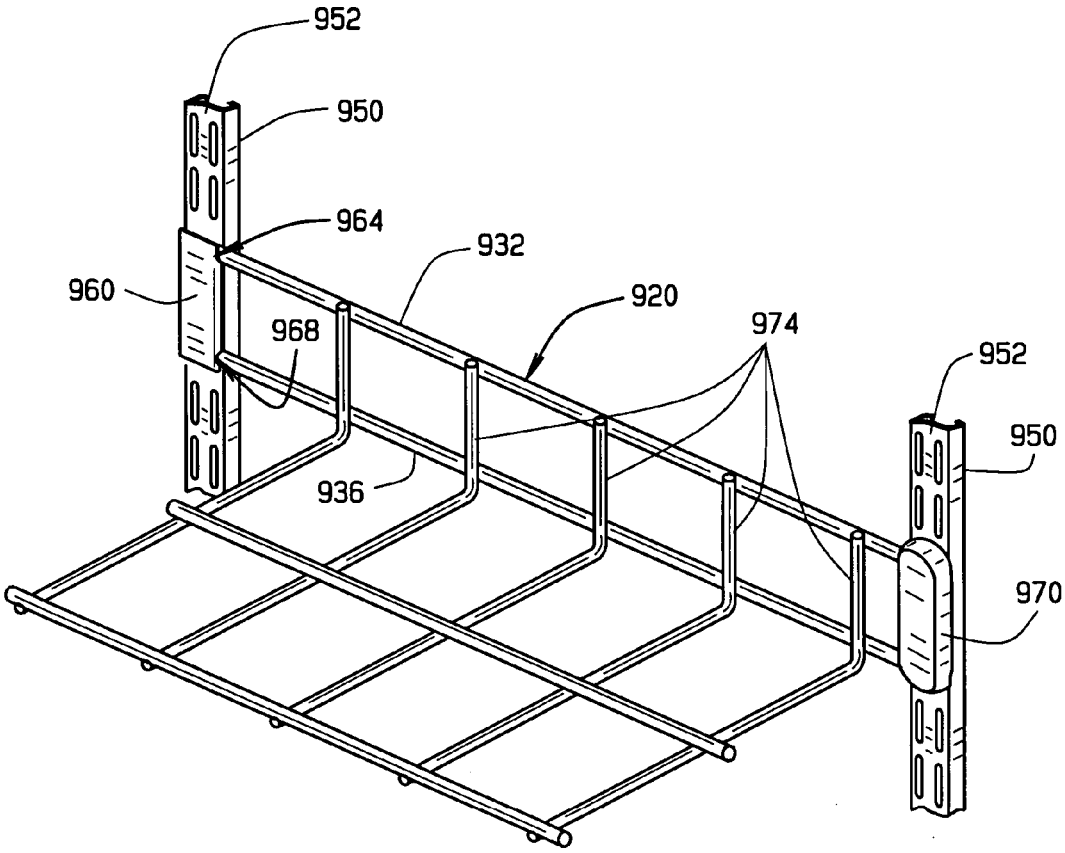
FIG. 21 is a perspective view showing a hanger/shelf component mounted generally between two wall standards with attachment members according to another exemplary embodiment of the invention.

With continued reference to FIG. 21, the hanger component 920 also includes spaced-apart bar portions 932 and 936. These bar portions 932 and 932 can allow the hanger component 920 to be mounted with an attachment member 960 to a wall standard 950 or other support surface, for example, by the attachment member trapping the spaced-apart bar portions 932, 936 substantially against the wall standard's front surface 952 and/or generally between the wall standard's front surface 952 and recessed portions 964 and 968 of the attachment member 960.

In this particular embodiment, the crossbars 932 and 936 generally extend horizontally and parallel with one another. The crossbars 932 and 936 contact the downwardly extending wire sections 974. The crossbars 932 and 936 can be secured to the wire sections 974 by means of welding, thermal bonding, adhesives, locking joints, combinations thereof, among other suitable means for joining bar portions.

In some embodiments, a cover member 970 is provided for covering the hanger component 920 and attachment member 960. The cover member 970 may be positioned over the attachment member 960 and/or over the bars of the hanger component 920. In various embodiments, the cover 970 comprises a push-on or push-fit cover that effectively hides the mounting hardware (e.g., screws, boss feature, etc.). The cover 970 can also provide a suitable surface for displaying indicia, such as one or more advertisements, trademarks, trade names, service marks, graphic images, graphic elements, designs, artwork, distinctive marks, identifying symbols, company logos, company contact information, text, alphanumeric characters, sports team insignias, names, monograms, photographs, among others. In some embodiments, the outer surface portion of the cover may include integrally formed (e.g., integrally molded, etched, carved, etc.) indicia thereon. Alternatively, the outer surface portion of the cover may simply provide an area that is conducive for printing and/or adhesively affixing a label thereto. Accordingly, various embodiments can provide an end product having an improved finished look, which can also accommodate company branding (or other indicia displaying) and find greater utility in more areas of the home, office, or other place of use.

In other aspects, the invention relates to attachment members (e.g., bracket clips, etc.) that can be releasably attachable to a wall-mounted standard. In various embodiments, an attachment member has a channel (e.g., generally C-shaped channel, generally U-shaped channel, etc.) extending lengthwise and generally vertically when the attachment member is mounted to a vertical wall-mounted standard. The attachment member includes at least one recessed portion (e.g., formed portion, notched portion, saddle, etc.) that together with the standard can cooperatively trap at least one wire or bar portion of a hook/hanger component between the attachment member and the standard, to thereby retain the wire portion against the wall standard. By way of example, various embodiments include an attachment member that causes two spaced-apart bar portions of a hook/hanger component to abut and directly contact a front surface of a standard. Alternatively, the two spaced-apart bar portions of the hanger component may be cooperatively trapped between a surface on the attachment member and the front surface of the standard, where the spaced-apart bar portions are generally retained against or maintain a floating contact with the standard.

In various embodiments, the attachment member can also include one or more tabs for engaging apertures (e.g., notches, slots, holes, etc.) in the wall standard, thereby allowing the attachment member and the hook/hanger component to be selectively positioned along the wall standard via the selective engagement of the attachment member to the standard without using any tools.

Figure 22:
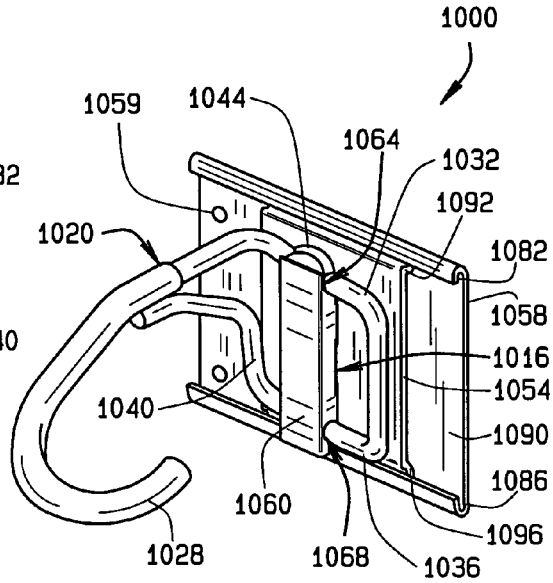
FIG. 22 is a perspective view showing a hanger component mounted to a track standard according to another exemplary embodiment of the invention.

Referring now to FIG. 22, there is shown one exemplary embodiment of a system 1000 embodying one or more aspects of the invention. As shown in FIG. 22, the system 1000 generally includes a wall or track standard 1058, a track mount or carrier 1054, a hanger component 1020 having spaced-apart bar portions 1032 and 1036, and an attachment member 1060. As shown, the attachment member 1060 retains the hanger component 1020 to the track mount 1054, which, in turn, is slidably mounted to the track standard 1058. The track standard 1058 can be attached to a wall or other support surface, for example, by fasteners received within fastener holes 1059.

The attachment member 1060 includes first and second recessed portions 1064 and 1068 respectively configured for trapping the spaced-apart bar portions 1032 and 1036 between the track mount 1054 and the attachment member 1060 when the attachment member 1060 is engaged to the track mount 1054. In this exemplary manner, the attachment member 1060 operatively retains the hanger component 1020 to the track mount 1054.

The wall or track standard 1058 includes an upper slot or groove 1082 and a lower slot or groove 1086. The slots 1082 and 1086 are disposed longitudinally along the track standard's front surface 1090. A track mount 1054 may be slidably disposed relative to the slots 1082 and 1086 respectively, for adjustably positioning the track mount 1054 relative to the track standard 1058. Aspects of the invention, however, are not so limited, as other embodiments can include track standards having differently configured (e.g., arranged, shaped, sized, etc.) apertures or other means for positioning.

The track mount 1054 includes upper and lower edge portions 1092 and 1096 configured to be slidably received within the respective upper and lower slots 1082 and 1086 of the track standard 1058. The track mount 1054 can further include a plurality of apertures 1016 (e.g., slots, holes, openings, notches, etc.) to allow engagement of an attachment member 1060 thereto. In this particular embodiment, the track mount 1054 includes two columns of spaced-apart slots 1016 disposed along the track mount's front surface 1052, which as described herein can receive tabs of an attachment member. Aspects of the invention, however, are not so limited, as other embodiments can include track mounts having differently configured (e.g., arranged, shaped, sized, etc.) apertures or other means for engaging the attachment member.

The system 1000 shown in FIG. 22 further comprises a hanger component 1020 having one or more wires or bar portions 1040 extending outwardly to form one or more end portions 1028 for supporting one or more items thereon. The hanger component 1020 further includes the spaced-apart bar portions 1032 and 1036 that can be operatively trapped between the track mount 1054 and the attachment member 1060. Alternatively, the hanger component's bar portions 1032 and 1036 may also be adapted to be operatively trapped between other apertured support surface, such as a wall standard, track standard, etc.

The first and second bar portions 1032 and 1036 can be sufficiently spaced apart from each other to allow the attachment member 1060 (or at least a portion thereof) to be positioned generally between the bar portions 1032 and 1036 and then engaged with the track mount 1054.

The attachment member 1060 includes first and second recessed portions 1064 and 1068 that are respectively configured together with the track mount 1054 for cooperatively trapping the spaced-apart crossbar portions 1032 and 1036 between the track mount 1054 and the attachment member 1060. In this exemplary manner, this trapping helps retain the wire portions 1032 and 1036 against the track mount 1054, thereby mounting the hanger component 1020 to the track mount 1054.

The spacing between the first and second recessed portions 1064 and 1068 relative to the spacing between the bar potions 1032 and 1036 of the hanger component 1020 can be configured such that vertical movement of the hanger component 1020 relative to the attachment member 1060 is inhibited by the attachment member 1060. At least one bar portion 1032 and 1036 of the hanger component 1020 may be cooperatively trapped between the surface of the first recessed portion 1064 and the front surface of the track mount 1054.

In some embodiments, the attachment member 1060 may cause the bar portions 1032 and 1036 to abut and directly contact a front surface 6of the track mount 1054. Alternatively, the bar portions 1032, 1036 of the hanger component 1020 may be cooperatively trapped between surface of the recessed portions 1064, 1068 of the attachment member 1060 and the front surface of the track mount 1054, in which case the bar portions 1032, 1036 are generally retained against the track mount 1054. For example, the bar portions 1032, 1036 may maintain floating contact with the front surface of the track mount 1054 and the surfaces defining the recessed portions 1062, 1068 of the attachment member 1060.

The spacing between the recessed portions 1064 and 1068 of the attachment member 1060 and the track mount 1054 can be configured such that outward movement of the hanger component 1020 away from the track mount 1054 is inhibited by the recessed portions 1064 and 1068. The spacing between the two crossbar portions 1032 and 1036 of the hanger component 1020 can also be configured such that vertical movement of the hanger component 1020 relative to the attachment member 1060 is inhibited by the attachment member 1060. The first and second recessed portions 1064 and 1068 in the attachment member 1060 can also be spaced relative to the spaced-apart crossbar portions 1032 and 1036 of the hanger component 1020 such that vertical movement of the hanger component 1020 relative to the attachment member 1060 is limited. In this exemplary manner, the attachment member 1060 can thus retain the hanger component 1020 to the track mount 1054 in a relatively secure manner such that movement of the hanger component 1020 relative to the track mount 1054 is inhibited by the attachment member 1060.

The attachment member 1060 may further include tabs. Each tab may include downwardly extending portions that define a notch on the inner side of the tab for receiving a portion of the track mount 1054. In various embodiments, engagement of the attachment member's notches with the track mount 1054 establishes an interference or frictional fit of the spaced-apart bar portions 1032 and 1036 between the attachment member 1060 and the track mount 1054. By way of example only, the attachment member 1060 may include tabs and notches substantially similar to the tabs 1362, 1462 and notches 1366, 1466 shown respectively in FIGS. 28 and 29 for the attachment members 1360 and 1460.

In various embodiments, the hanger component 1020 of system 1000 may further comprise a tapered section and a reduced width portion 1044 on at least one of the two spaced-apart bar portions 1032 and 1036. By way of example only, the hanger component 1020 may be include tapered sections and reduced width portions substantially similar to the tapered sections 142, 144, 242 244 shown in FIGS. 8, 9, 11, and 12 for the hanger components 120', 120", 220', and 220".

In various embodiments, the hanger component's reduced width portion can be adapted to be received within the recessed portion 1064, 1068 of the attachment member 1060 for operatively trapping the reduced width portion of the hanger component 1020 against a track mount 1054 when the attachment member 1060 is engaged with the track mount 1054. In one aspect, the tapered section that leads into the reduced width portion in the bar 1032 of the hanger component 1020 is configured to limit horizontal side-to-side movement of the hanger component 1020 relative to the attachment member 1060. Specifically, when an attachment member 1060 is positioned to trap the reduced width portion against a standard or other vertical surface, the tapered section of the bar 1032 is inhibited from moving horizontally towards the attachment member 1060 by virtue of the tapered section being wider than the reduced width portion received within a recess 1064, 1068 in the attachment member 1060.

Figure 23:
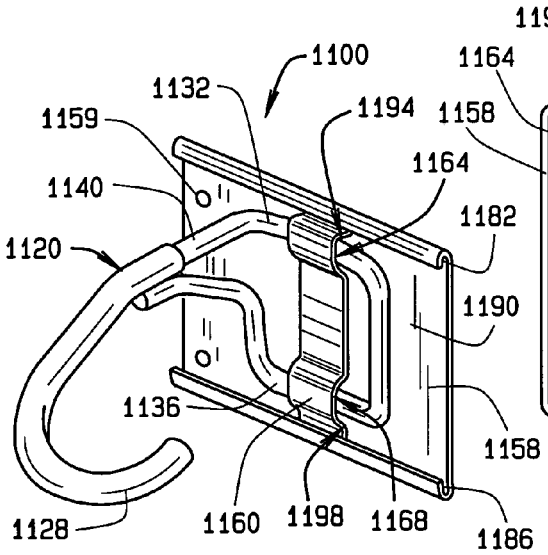
FIG. 23 is a perspective view of a hanger component mounted to a track standard with an attachment member according to another exemplary embodiment of the invention.
Figure 24:
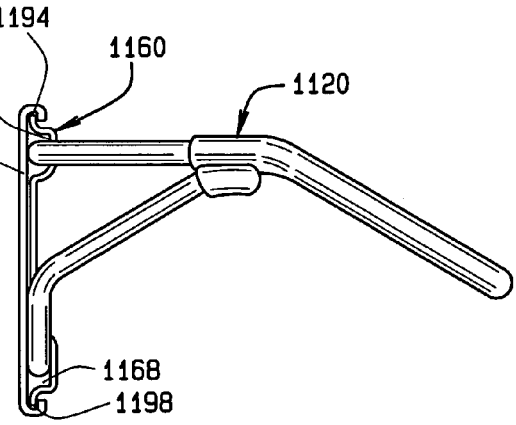
FIG. 24 is a side elevation view of the components shown in FIG. 23.

FIGS. 23 and 24 illustrate another system 1100 embodying one or more aspects of the invention. As shown in FIGS. 23 and 24, the system 1100 generally includes a wall or track standard 1158, a hanger component 1120 having two spaced-apart bar portions 1132 and 1136, and an attachment member 1160 engagable to the track standard 1158. The attachment member 1160 includes first and second recessed portions 1164 and 1168 that cooperate with the track standard 1158 to operatively trap at least one wire portion 1132, 1136 of the hook or hanger component 1120 between the attachment member 1160 and the track standard 1158, to thereby retain the wire portion 1132, 1136 against the track standard 1158. The track standard 1158 can be attached to a wall or other support surface, for example, by fasteners received within fastener holes 1159.

As shown in FIG. 23, the track standard 1158 includes an upper slot or groove 1182 and a lower slot or groove 1186. The slots 1182 and 1186 are disposed longitudinally along the track standard's front surface 1190. An attachment member 1160 may be slidably engaged with the slots 1182 and 1186, to thereby allow for adjustable positioning of the attachment member 1160 relative to the track standard 1158. Aspects of the invention, however, are not so limited, as other embodiments can include track standards having differently configured (e.g., arranged, shaped, sized, etc.) apertures or other means for positioning.

The system 1100 shown in FIGS. 23 and 24 further comprises a hanger component 1120 having one or more wires or bar portions 1140 extending outwardly to form one or more ends 1128 for supporting one or more items thereon. The hanger component 1120 further includes the spaced-apart bar portions 1132 and 1136 that can be operatively trapped between the track standard 1158 and the attachment member 1160. Alternatively, the hanger component's bar portions 1132 and 1136 may also be adapted to be operatively trapped between other support surfaces, such as a wall or a wall-mounted standard.

The first and second bar portions 1132 and 1136 can be sufficiently spaced apart from each other to allow the attachment member 1160 (or at least a portion thereof) to be positioned generally between the bar portions 1132 and 1136 and then engaged with the wall or track standard 1158. The attachment member 1160 may comprise recessed portions 1164 and 1168 that provide for operatively trapping the first and second bar portions 1132 and 1136 between the track standard 1158 and the attachment member 1160. This trapping helps retain the wire portions 1132 and 1136 against the track standard 1158, thereby mounting the hanger component 1120 to the track standard 1158.

In various embodiments, the bar portions 1132 and 1136 of the hanger component 1120 may further comprise one or more tapered sections and one or more reduced width portions. In such embodiments, the reduced width portion can be adapted to be received within a recessed portion 1164, 1168 of an attachment member 1160, for trapping the reduced width portion of the hanger component 1120 against a track standard 1158 when the attachment member 1160 is engaged with the track standard 1158. By way of example only, the hanger component 1120 may be include tapered sections and reduced width portions substantially similar to the tapered sections 142, 144, 242 244 shown in FIGS. 8, 9, 11, and 12 for the hanger components 120', 120", 220', and 220".

With continued reference to FIGS. 23 and 24, the attachment member 1160 includes first and second end portions 1194 and 1198 that are configured to be slidably received within the respective upper and lower slots 1182 and 1186 of the track standard 1158. The attachment member 1160 may be slidably engaged with the slots 1182 and 1186 of the track standard 1158, which allows for adjustable positioning of the attachment member 1160 relative to the track standard 1158.

The attachment member 1160 further comprises at least two recessed portions 1164 and 1168 for receiving the spaced-apart bar portions 1132 and 1136 of the hanger component 1120. The recessed portions 1164 and 1168 provide for operatively trapping the first and second bar portions 1132, 1136 between the front surface of the track standard 1158 and the back surface of the attachment member 1160 when the attachment member 1160 is engaged with the track standard 1158.

The spacing between the recessed portions 1164 and 1168 relative to the spacing between the bar potions 1132 and 1136 of the hanger component 1120 can be configured such that vertical movement of the hanger component 1120 relative to the attachment member 1160 is inhibited by the attachment member 1160. The spacing between the recessed portions 1164, 1168 of the attachment member 1160 and the track standard 1158 can be configured such that outward movement of the hanger component 1120 away from the track standard 1158 is inhibited by the recessed portions 1164, 1168 of the attachment member 1160. The spacing between the bar portions 1132, 1136 of the hanger component 1120 can be configured such that vertical movement of the hanger component 1120 relative to the attachment member 1160 is inhibited by the attachment member 1160. In this exemplary manner, the attachment member 1160 can thus retain the hanger component 1120 to the track standard 1158 in a relatively secure manner such that movement of the hanger component 1120 relative to the track standard 1158 is inhibited by the attachment member 1160.

At least one bar portion 1132 and 1136 of the hanger component 1120 can be operatively trapped between a surface of a recessed portion 1164, 1168 of the attachment member 1160 and the front surface of the track standard 1158. In some embodiments, the attachment member 1160 may cause the bar portions 1132 and 1136 to abut and directly contact a front surface of the track standard 1158. Alternatively, the bar portions 1132, 1136 of the hanger component 1120 may be cooperatively trapped between surfaces of the recessed portions 1164, 1168 of the attachment member 1160 and the front surface of the track standard 1158, in which case the bar portions 1132, 1136 are generally retained against the track standard 1158. For example, the bar portions 1032, 1036 may maintain floating contact with the front surface of the track standard 1158 and the surfaces defining the recessed portions 1164, 1168 of the attachment member 1160.

The attachment member 1160 shown in FIGS. 23 and 24 generally comprises first and second end portions 1194 and 1198. The end portions 1194 and 1198 can be formed to provide edges adapted to be slidably engaged within the respective upper and lower slots 1184 and 1186 of the track standard 1158.

The recessed portions 1164 and 1168 of the attachment member 1160 comprise a generally C-shaped curve adapted to trap or clamp a bar portion 1132, 1136 of the hanger component 1120 against a surface. The spacing between the recessed portions 1164 and 1168 can be made relative close to that of the spacing between the two bar portions 1132, 1136 of the hanger component 1120, such that vertical movement of the hanger component 1120 relative to an attachment member 1160 is limited by the engagement of the spaced-apart bar portions 1132 and 1136 within the recessed portions 1164 and 1168. Accordingly, the bar portions 1132 and 1136 may be operatively trapped by the attachment member 1160 against a standard in a manner that inhibits movement of the hanger component 1120 relative to the attachment member 1160 and the standard.

In alternate embodiments, the hanger component 1120 may include one or more tapered sections and reduced width portions. In one specific embodiment, the bar portions 1132 of the hanger component 1120 includes a tapered section leading into a reduced width portion of the bar 1132. This tapered sections can inhibit and limit horizontal side-to-side movement of the hanger component 1120 relative to the attachment member 1160. When the recessed portions 1164, 1168 of the attachment member 1160 are disposed over a reduced width portion of a bar portion of the hanger component 1120, the tapered section of the bar portion 1132 is inhibited from moving horizontally relative to the attachment member 1160 by virtue of the tapered section being wider than the reduced width portion received within the recessed portion 1164, 1168 of the attachment member 1160.

Figure 25:
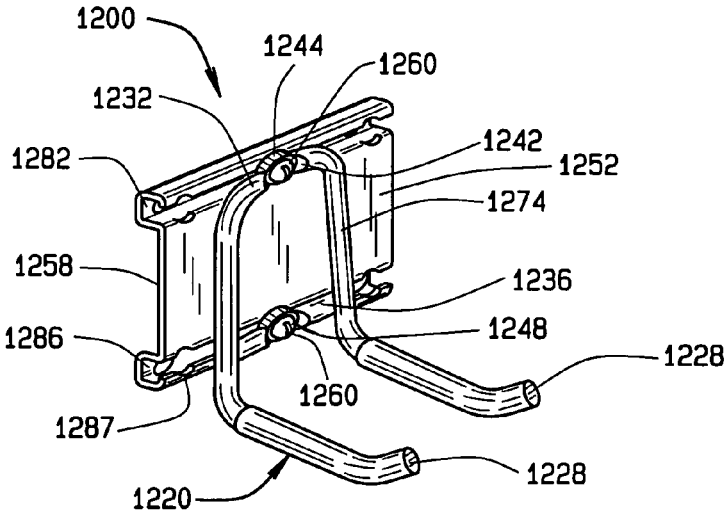
FIG. 25 is a perspective view showing a hanger component mounted to a track standard according to another exemplary embodiment of the invention.
Figure 26:
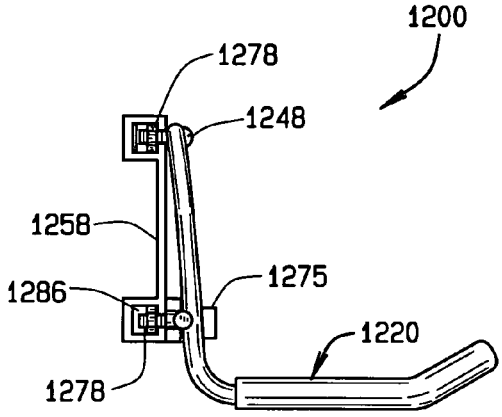
FIG. 26 is a side elevation view of the components shown in FIG. 25.

FIGS. 25 and 26 illustrate another exemplary embodiment of a system 1200 embodying one or more aspects of the invention. As shown in FIGS. 25 and 26, the system 1200 generally includes a track standard 1258 having two generally parallel slots or channels 1282 and 1286. The system 1200 also includes a hanger component 1220 having two spaced-apart bar portions 1232 and 1236, and an attachment member 1260 engagable to the slots 1282 and 1286 of the track standard 1258. In this particular illustrated embodiment, the attachment member 1260 comprises fasteners 1248 that operatively trap the spaced-apart crossbar portions 1232 and 1236 between the track standard 1258 and the attachment means 1248 when the attachment means 1248 is engaged with the slots 1282 and 1286 in the track standard 1258. In this exemplary manner, the attachment means 1248 thus retains the hanger component 1220 to the track standard 1258.

The track standard's upper and lower slots 1282 and 1286 are generally parallel to one another and extend along the track standard's front surface 1252. The attachment member 1260 may be slidably engaged within the upper and lower slots 1282 and 1286, for adjustably positioning the hanger component 1220 relative to the track standard 1258. By way of example, an attachment member 1260 may be slidably inserted into a slot 1282, 1286 from an open end portion of the slot 1282, 1286. Or, for example, an attachment member 1260 may be slidably engaged within a slot 1282, 1286 by inserting a portion (e.g., a nut 1278, etc.) of the attachment member 1260 through an opening 1287 of a slot 1282, 1286. Aspects of the invention, however, are not so limited, as other embodiments can include track standards having differently configured (e.g., arranged, shaped, sized, etc.) apertures or other means for positioning.

The system 1200 shown in FIGS. 25 and 26 also includes a hanger component 1220 having one or more wire sections or bar portions 1274 extending outwardly to form one or more ends 1228 for supporting one or more items thereon. The hanger component's spaced-apart bar portions 1232 and 1236 are adapted to be operatively trapped between the track standard 1258 and the attachment member 1260.

As shown in FIG. 25, the bar portions 1232, 1236 of the hanger component 1220 may further comprise tapered sections 1242 and reduced width portions 1244. The reduced width sections 1244 further include openings therethrough for receiving the fasteners 1248 for operatively trapping the hanger component 1220 to a wall or to a track standard 1258, which, may, in turn, be mounted to a wall. Accordingly, the system 1200 includes at least one attachment member 1248 for retaining at least one bar portion 1232, 1236 of the hanger component 1220 to the track standard 1258.

In the illustrated embodiment of FIG. 26, the attachment member 1260 generally comprises a fastener 1248, such as a screw and an associated nut 1278. Alternative embodiments, however, can include other attachment members besides screws, nuts, bolts, etc. By way of further example, a plug 1275 having an end portion with an associated locking sleeve or washer 1278, or other combination of components suitable for assembly that may be received within the tracks 1282, 1286. As shown in FIG. 26, the attachment member or fastener 1248 is positioned relative to the at least one opening through a bar portion 1232, 1236 of the hanger component 1220, such that the nut or sleeve 1278 associated with the fastener 1248 may be received within a slot 1282, 1286 of the wall-mounted track standard 1258 to operatively trap the bar portion 1232, 1236 of the hanger component 1220 between the attachment member 1260 (or fastener 1248) and the front surface of the wall-mounted track standard 1258.

In this exemplary manner, at least one bar portion 1232, 1236 of the hanger component 1220 is operatively trapped between the attachment member 1260 and the front surface of the track standard 1258. In some embodiments, the attachment member 1260 may cause the bar portions 1232 and 1236 to abut and directly contact a front surface of the track standard 1258. Alternatively, the bar portions 1232, 1236 of the hanger component 1220 may be cooperatively trapped between the attachment member 1260 and the front surface of the track standard 1258, in which case the bar portions 1232, 1236 are generally retained against the track standard 1258. For example, the bar portions 1232, 1236 may maintain floating contact with the front surface of the track standard 1258 and the attachment member 1260.

The spacing between the two crossbar portions 1232 and 1236 of the hanger component 1220 relative to the spacing between the tracks 1282 and 1286 can be configured such that vertical movement of the hanger component 1220 relative to the track standard 1258 is inhibited by the attachment fasteners 1248. In this exemplary manner, the attachment member 1260 or fastener 1248 thereby retains the hanger component 1220 to the track standard 1258 in a manner such that outward movement or vertical of the hanger component 1220 relative to the track standard 1258 is inhibited by the attachment member 1260.

Figure 27:
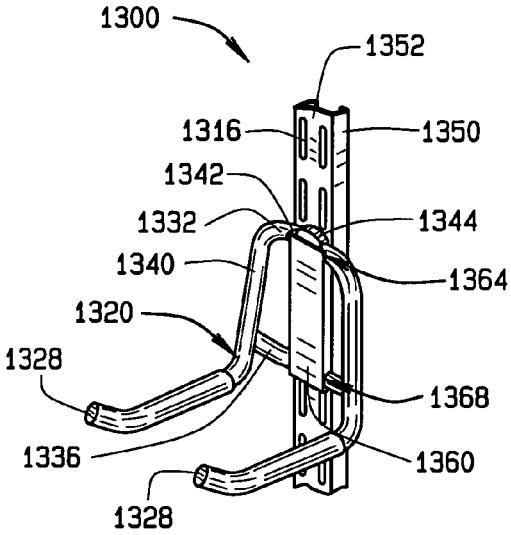
FIG. 27 is a perspective view showing a hanger component mounted to a wall standard with an attachment member according to another exemplary embodiment of the invention.

FIG. 27 illustrates another exemplary embodiment of a system 1300 embodying one or more aspects of the invention. As shown in FIG. 27, the system 1300 generally includes a wall standard 1350, a hanger component 1320 having two spaced-apart bar portions 1332 and 1336, and an attachment member 1360 (also shown in FIG. 28). The attachment member 1360 includes first and second recessed portions 1364 and 1368 that are respectively configured together with the standard 1350 to cooperatively trap at least one wire portion 1332, 1336 of the hanger component 1320 between the attachment member 1360 and the standard 1350, to thereby retain the hanger component 1320 to the wall standard 1350.

The wall standard 1350 includes a plurality of apertures 1316 therein. In the illustrated embodiment, the wall standard 1350 includes two columns of spaced-apart slots 1316 disposed along the wall standard's front surface 1352. Aspects of the invention, however, are not so limited, as other embodiments can include wall standards having differently configured (e.g., arranged, shaped, sized, etc.) apertures or other means for engaging a bracket clip.

Figure 28:
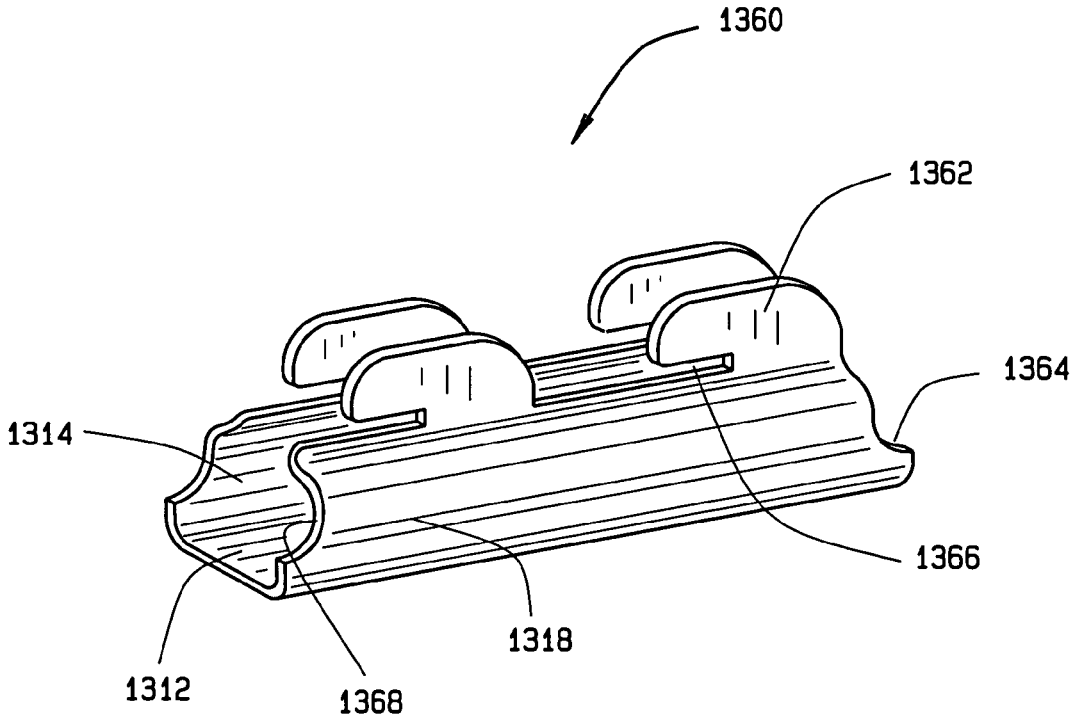
FIG. 28 is a perspective view of an attachment member that can be used for mounting a hanger component to a wall standard according to another exemplary embodiment of the invention.

As shown in FIG. 28, the attachment member 1360 in one embodiment includes spaced-apart tabs 1362 that extend outwardly and downwardly from the attachment member 1360. The tabs 1362 are configured to be engaged with the slots 1316 of the wall standard 1350 (FIG. 27). The upper portion of the attachment member 1360 includes a first recessed portion 1364 configured for trapping the hanger component's crossbar portion 1332 between the wall standard 1350 and the attachment member 1360. The lower portion of the attachment member 1360 includes a second recessed portion 1368 configured for trapping the other spaced-apart crossbar portion 1336 of the hanger component 1320 between the wall standard 1350 and the attachment member 1360. By trapping the crossbar portions 1332 and 1336 in this exemplary manner, the attachment member 1360 can thus retain the hanger component 1320 to the wall standard 1350.

The spaced-apart bar portions 1332 and 1336 of the hanger component 1320 provide an opening therebetween sufficiently sized to allow a portion of the attachment member 1360 therethrough for engaging the standard 1350. In various embodiments, the spaced-apart bar portions 1332 and 1336 define an opening width that is sized relative close to that of the attachment member 1360, such that vertical movement of the hanger component 1320 relative to the attachment member 1360 is limited by the engagement of the bar portions 1332 and 1336 within the recessed portions 1364 and 1368. Accordingly, the hanger component 1320 thus includes two spaced-apart bar portions 1332 and 1336 that may be operatively trapped by the attachment member 1360 against the wall standard 1350, with the spaced-apart bar portions 1332 and 1336 providing an opening through which the attachment member 1360 may engage the standard 1350 to trap the bar portions 1332 and 1336 in a manner that inhibits movement of the hanger component 1320 relative to the attachment member 1360 and standard 1350.

With continued reference to FIG. 27, the crossbar portion 1332 comprises one or more wire sections 1340 extending generally outwardly therefrom that form one or more hooks 1328 for supporting one or more items thereon. The opposing end portions of the second crossbar portion 1336 are in contact with the downwardly extending portions 1340 of the first crossbar portion 1332.

The spacing between the first and second recessed portions 1364 and 1368 relative to the spacing between the two bar portions 1332 and 1336 of the hanger component 1320 can be configured such that vertical movement of the hanger component 1320 relative to the attachment member 1360 is inhibited by the attachment member 1360. The spacing between the recessed portions 1364, 1368 of the attachment member 1360 and the wall standard 1350 can be configured such that outward movement of the hanger component 1320 relative to the wall standard 1350 is inhibited by the recessed portions 1364, 1368 of the attachment member 1360. The spacing between the two crossbar portions 1332 and 1336 of the hanger component 1320 can be configured such that vertical movement of the hanger component 1320 relative to the attachment member 1360 is inhibited by the attachment member 1360. In this exemplary manner, the attachment member 1360 can thus retain the hanger component 1320 to the wall standard 1350 in a relatively secure manner such that outward movement or vertical movement of the hanger component 1320 relative to the wall standard 1350 is inhibited by the attachment member 1360.

In some embodiments, the attachment member 1360 may cause the bar portions 1332 and 1336 to abut and directly contact a front surface of the wall standard 1350. Alternatively, the bar portions 1332, 1336 of the hanger component 1320 may be cooperatively trapped between surface of the recessed portions 1364, 1368 of the attachment member 1360 and the front surface of the wall standard 1350, in which case the bar portions 1332, 1036 are generally retained against the wall standard 1350. For example, the bar portions 1032, 1036 may maintain floating contact with the front surface of the wall standard 1350 and the surfaces defining the recessed portions 1362, 1368 of the attachment member 1360.

In various embodiments, the attachment member 1360 shown in FIG. 28 comprises a channel 1312 with first and second spaced-apart sidewalls 1314 and 1318. The sidewalls 1314 and 1318 include tabs 1362 that extend outwardly and downwardly from the sidewalls. The downwardly extending portion of the tab 1362 defines a notch or opening 1366 between the tab 1362 and the corresponding sidewall 1314, 1318. In various embodiments, the notches 1366 can be receive a portion of the wall standard 1350, such that engagement of the notch 1366 within an aperture 1316 of the wall standard 1350 establishes a frictional fit of the crossbar portions 1332, 1336 between the attachment member 1360 and the wall standard 1350.

In various embodiments, the hanger component 1320 may further comprise one or more tapered sections 1342 and reduced width portions 1344. In such embodiments, the reduced width portions 1344 may be adapted to be received within the recessed portions 1364, 1368 of the attachment member 1360 (or other suitable attachment member) for trapping the reduced width portions 1344 of the hanger component 1320 against the wall standard 1350 when the attachment member 1360 is engaged with the wall standard 1350.

The tapered sections 1342, which generally lead into the reduced width portions 1344 of the bar portions 1332, 1336, can be configured to limit horizontal side-to-side movement of the hanger component 1320 relative to the attachment member 1360. When a recessed portion 1364, 1368 of the attachment member 1360 is over a reduced width portion 1344 of the hanger component 1320, the tapered section 1342 of the spaced-apart bar portion 1332, 1336 can inhibit the hanger component 1320 from moving horizontally relative to the attachment member 1360 by virtue of the tapered section 1342 being wider than the reduced width portion 1344 received within the recessed portion 1364, 1368 of the attachment member 1360. Accordingly, the attachment member 1360 thereby limits horizontal side-to-side movement of the hanger component 1320 relative to the attachment member 1360. The attachment member 1360 also retains the hanger component 1320 to the track standard 1350 in a manner such that outward movement of the hanger component 1320 relative to the track standard 1350 is inhibited by the attachment member 1360. The first and second recessed portions 1364 and 1368 in the attachment member 1360 are also spaced relative to the spacing between the crossbar portions 1332 and 1336 of the hanger component 1320 such that vertical movement of the hanger component 1320 relative to the attachment member 1360 is limited.

In alternate embodiments, the hanger component 1320 with a reduced width section 1344 may also include at least one opening through the reduced width section 1344. The opening may be adapted to receive a fastener for further trapping the hanger component 1320 to a wall or a wall standard 1350.

Figure 29:
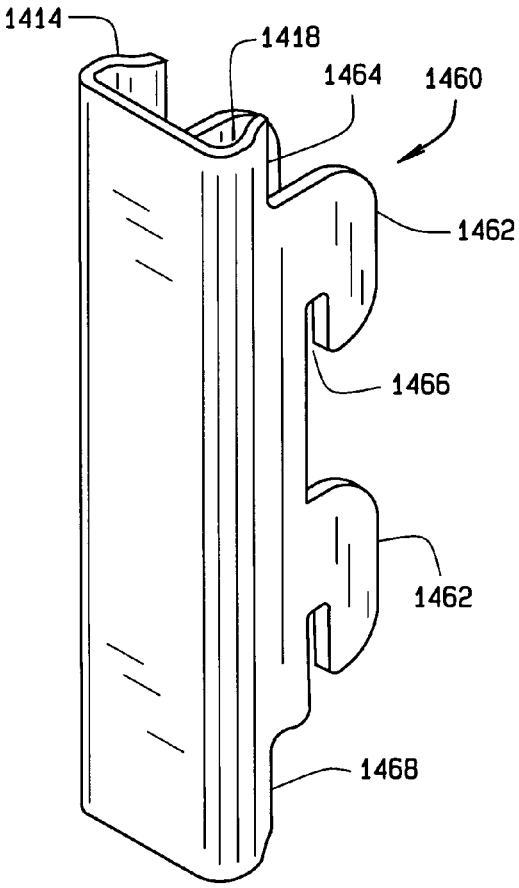
FIG. 29 is a perspective view of an attachment member that can be used for mounting a hanger component to a wall standard according to another exemplary embodiment of the invention.
Figure 31:
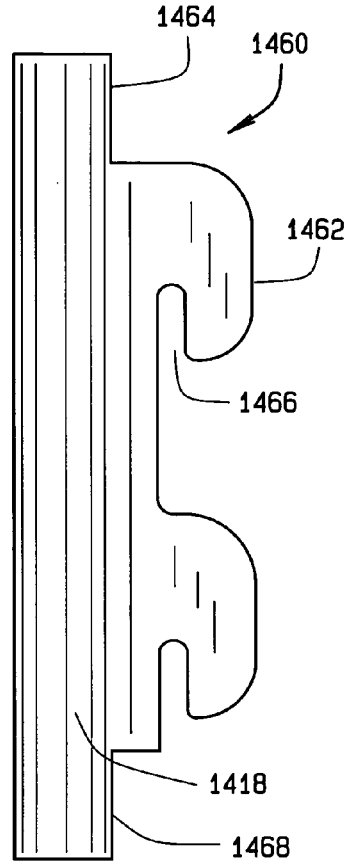
FIG. 31 is a right side elevation view of the attachment member shown in FIG. 29.
Figure 30:
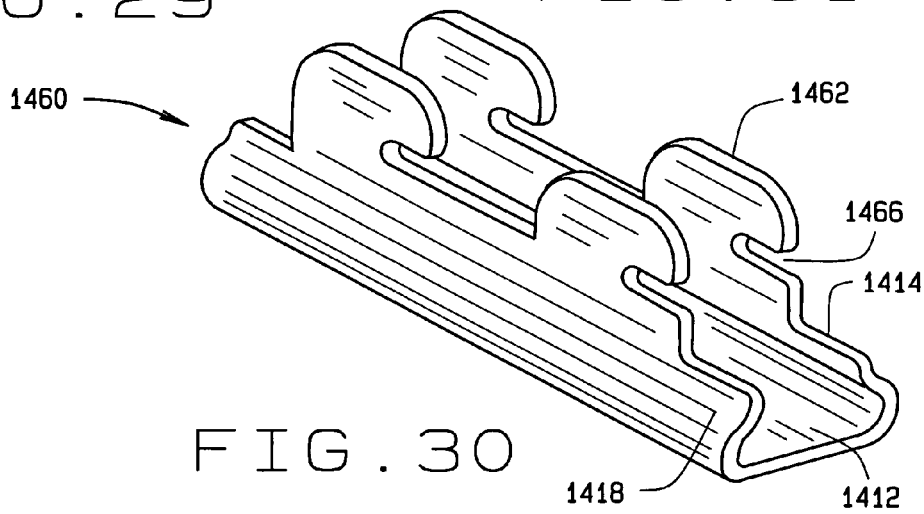
FIG. 30 is a back perspective view of the attachment member shown in FIG. 29.
Figure 32:
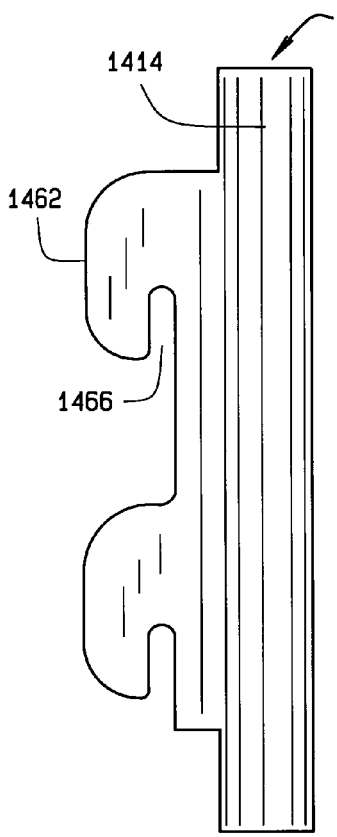
FIG. 32 is a left side elevation view of the attachment member shown in FIG. 29.
Figure 33:
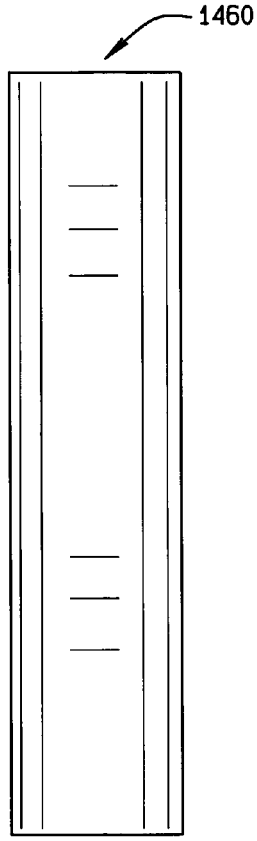
FIG. 33 is a front elevation view of the attachment member shown in FIG. 29.
Figure 34:
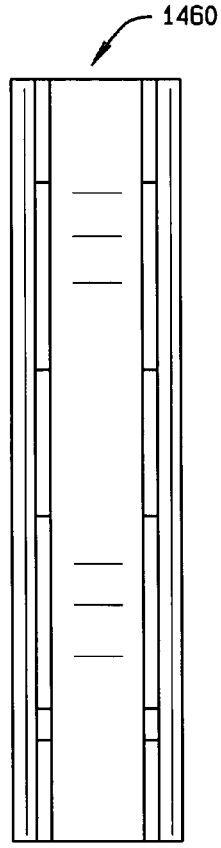
FIG. 34 is a back elevation view of the attachment member shown in FIG. 29.
Figure 35:
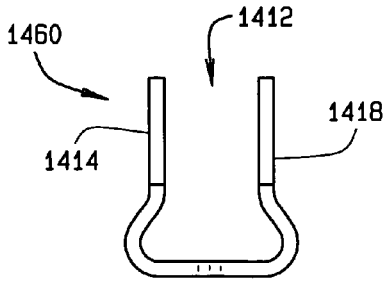
FIG. 35 is a top plan view of the attachment member shown in FIG. 29.
Figure 36:
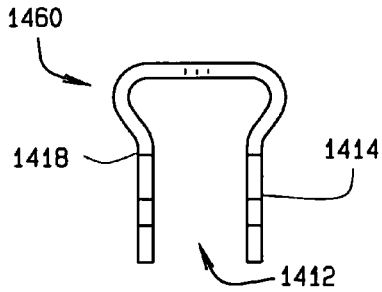
FIG. 36 is a bottom plan view of the attachment member shown in FIG. 29.

FIGS. 29 through 36 illustrate another embodiment of an attachment member 1460 embodying one or more aspects of the invention. As shown in FIGS. 29 and 30, the attachment member 1460 includes a channel 1412 with first and second spaced-apart sidewalls 1414 and 1418. The sidewalls 1414 and 1418 include tabs 1462 that extend outwardly and downwardly from the sidewalls 1414, 1418. The downwardly extending portion of each tab 1462 defines a notch or opening 1466 generally between the tab 1462 and the corresponding sidewall 1414, 1418. In various embodiments, the tabs 1462 and notches 1466 defined thereby are configured to engage apertures of a wall standard, such as slots 1416 of wall standard 1450 shown in FIG. 37. Alternatively, the tabs 1462 can be configured to engage other standards and/or other types of openings besides slots. In addition, the attachment member 1460 can also include more or less tabs (e.g., more or less than two tabs per sidewall, etc.), differently configured tabs and/or different attachment means for engaging a standard than what are shown in the figures.

The attachment member 1460 can be used to mount a wide variety of hook and hanger components to a wall standard or other apertured support surface. By way of example only, the attachment member 1460 can be used to mount any one of the various hanger components (e.g., 120, 220, 320, 420, 520, 620, 720, 820, 920, 1020, 1120, 1220, 1230, 1420, etc.) shown and described herein.

Figure 37:
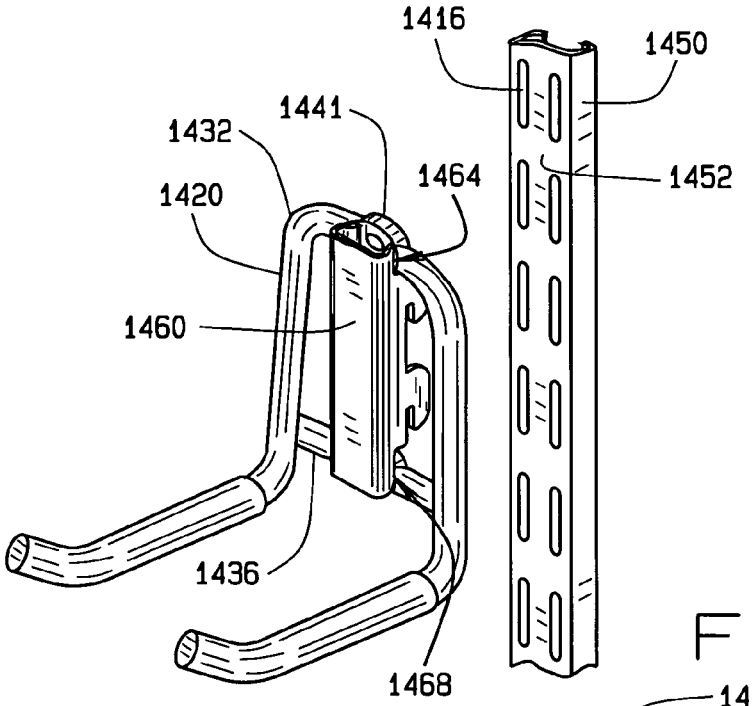
FIG. 37 is an exploded perspective view showing the attachment member of FIGS. 29 through 36 aligned for engagement with an exemplary wall standard for mounting an exemplary hanger component to the wall standard according to another exemplary embodiment of the invention.

FIG. 37 illustrates an exemplary embodiment of a system 1400 embodying one or more aspects of the invention. As shown in FIG. 37, the system 1400 generally includes the attachment member 1460 (shown in FIGS. 29 through 36), a wall standard 1450, and a hanger component 1420 having two spaced-apart bar portions 1432 and 1436. The attachment member 1460 includes upper and lower portions 1464 and 1468 that are respectively configured together with the standard 1450 to cooperatively trap at least one wire portion 1432, 1436 of the hanger component 1420 between the attachment member 1460 and the standard 1450, to thereby retain the hanger component 1420 to the wall standard 1450.

In the exemplary embodiment of FIG. 37, the attachment member 1460 is shown aligned for engagement with the double-slotted wall standard 1450 for mounting the exemplary hanger component 1420 to the wall standard 1450. As shown in FIG. 37, the wall standard 1450 includes two columns of spaced-apart slots 1416 disposed along the wall standard's front surface 1452. Aspects of the invention, however, are not so limited, as other embodiments can include wall standards having differently configured (e.g., arranged, shaped, sized, etc.) apertures or other means for engaging a bracket clip.

As shown in FIGS. 38 through 42, portions of the attachment member 1460 can cradle, wedge, and/or trap one or more portions of the hanger component 1420 against the front surface 1452 of the wall standard 1450. This trapping can provide for relatively securely mounting of the hanger component 1420 to the wall standard 1450. In various embodiments, portions of the attachment member 1460 can nest or be disposed within the coined features or bosses 1441 of the hanger component 1420 when the hanger component 1420 is mounted to the standard 1450 by the attachment member 1460. This nesting can help maintain vertical alignment of the hanger component 1420 and inhibit the hanger component 1420 from moving (e.g., sliding side-to-side, etc.) relative to the standard 1450 through contact between the nesting portions of the attachment member 1460 and the corresponding portions of the coining saddle 1441 (e.g., tapered portions 1442 and reduced width portions 1444, etc.) of the hanger component 1420 defining the coining saddle 1441.

In various embodiments, the hanger component 1420 may comprise one or more tapered sections 1442 and reduced width portions 1444. In such embodiments, the reduced width portions 1444 may be adapted to be received within the upper and lower recessed portions 1464, 1468 of the attachment member 1460 (or other suitable attachment member) for trapping the reduced width portions 1444 of the hanger component 1420 against the wall standard 1450 when the attachment member 1460 is engaged with the wall standard 1450.

The tapered sections 1442, which generally lead into the reduced width portions 1444 of the bar portions 1432, 1436, can be configured to limit horizontal side-to-side movement of the hanger component 1420 relative to the attachment member 1460. When a recessed portion 1464, 1468 of the attachment member 1460 is disposed over a reduced width portion 1444 of the hanger component 1420, contact between the tapered sections 1442 of the spaced-apart bar portions 1432, 1436 and the attachment member can inhibit the hanger component 1420 from moving horizontally relative to the attachment member 1460 by virtue of the tapered section 1442 being wider than the reduced width portion 1444 received within the recessed portion 1464, 1468 of the attachment member 1460. Accordingly, the attachment member 1460 thereby limits horizontal side-to-side movement of the hanger component 1420 relative to the attachment member 1460. The attachment member 1460 also retains the hanger component 1420 to the track standard 1450 in a manner such that outward movement of the hanger component 1420 relative to the track standard 1450 is inhibited by the attachment member 1460. The first and second recessed portions 1464 and 1468 in the attachment member 1460 are also spaced relative to the spacing between the crossbar portions 1432 and 1436 of the hanger component 1420 such that vertical movement of the hanger component 1420 relative to the attachment member 1460 is limited.

In alternate embodiments, the hanger component 1420 with a reduced width section 1444 may also include at least one opening 1446 (FIG. 42) through the reduced width section 1444. The opening 1446 may be adapted to receive a fastener for further securing the hanger component 1420 to a wall, wall standard 1450, or track standard.

Figure 38:
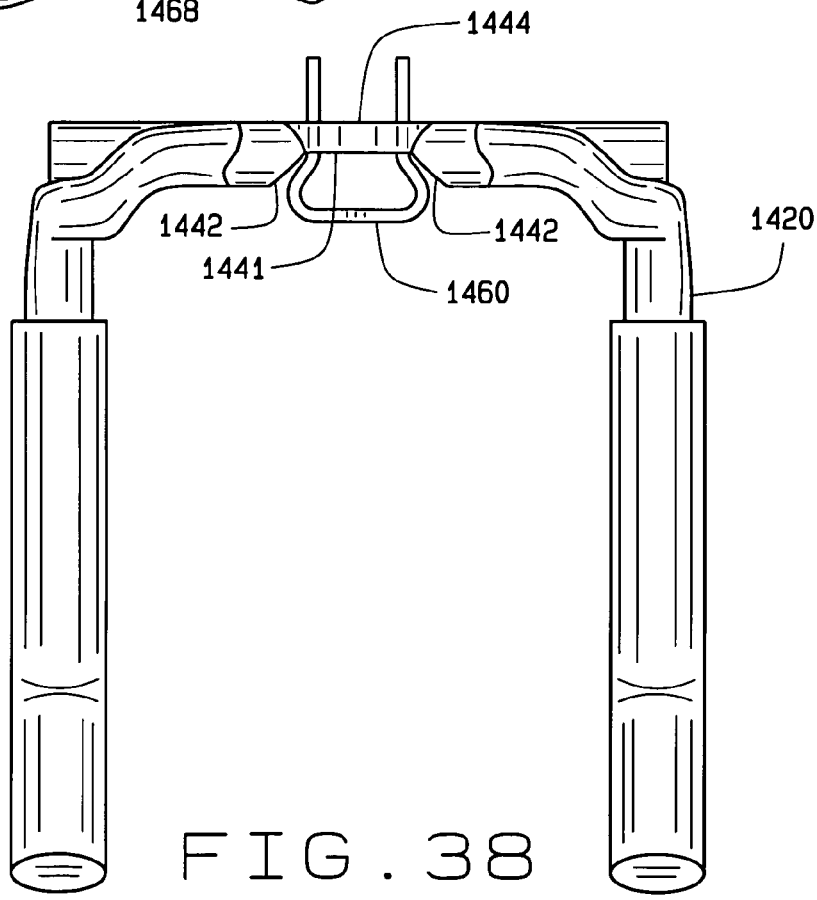
FIG. 38 is a top view of the attachment member and hanger component shown in FIG. 37.
Figure 39:
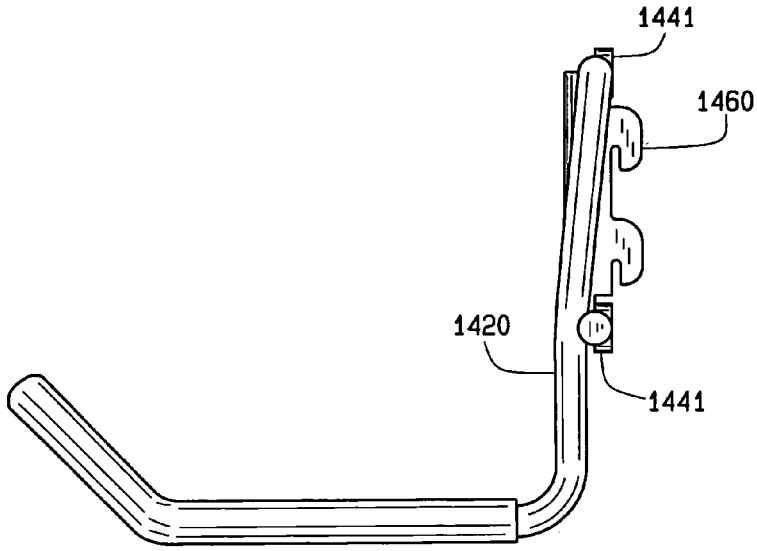
FIG. 39 is a right side elevation view of the attachment member and hanger component shown in FIG. 37.
Figure 40:
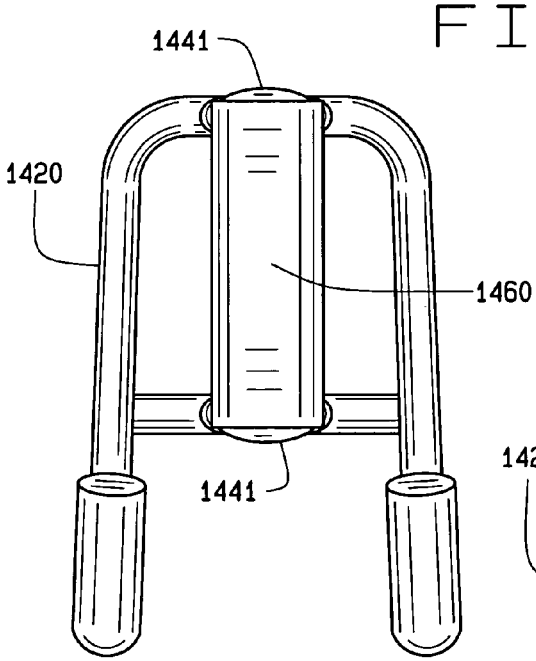
FIG. 40 is a front elevation view of the attachment member and hanger component shown in FIG. 37.

As shown in FIGS. 38 and 39, the back surface of the coined features or bosses 1441 may be substantially flat and be substantially flush with the tangent surface of the wire or bar portions 1432 and 1436. In such embodiments, the flat back surfaces of the bosses or coined features 1441 can accordingly lay flush with and abut against a corresponding flat support surface, e.g., a front surface of a wall standard, track, or wall, etc.

Figure 41A:
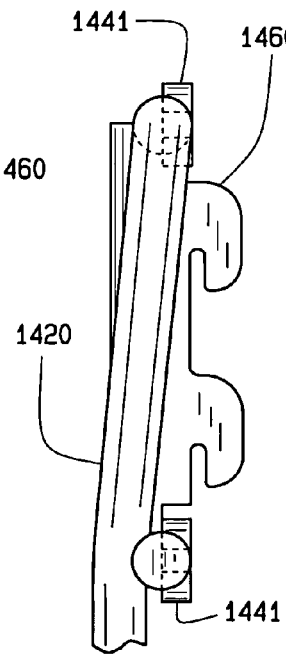
FIGS. 41A and 41B are side elevation views of the attachment member and a portion of the hanger component shown in FIG. 37.
Figure 41B:
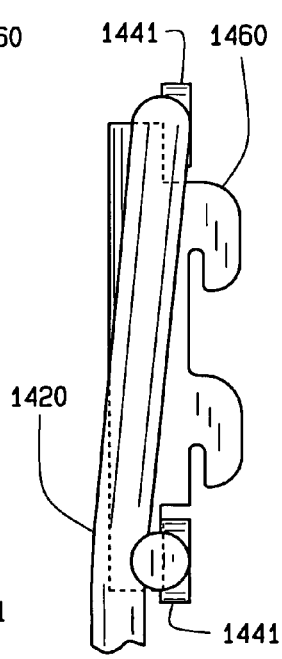

As shown in FIGS. 41A and 41B, some embodiments include the front surfaces of the coined features or bosses 1441 being substantially flat. In such embodiments, the flat front surfaces of the bosses or coined features 1441 can accordingly lie flush and abut against corresponding portions of the attachment member 1460.

Figure 42:
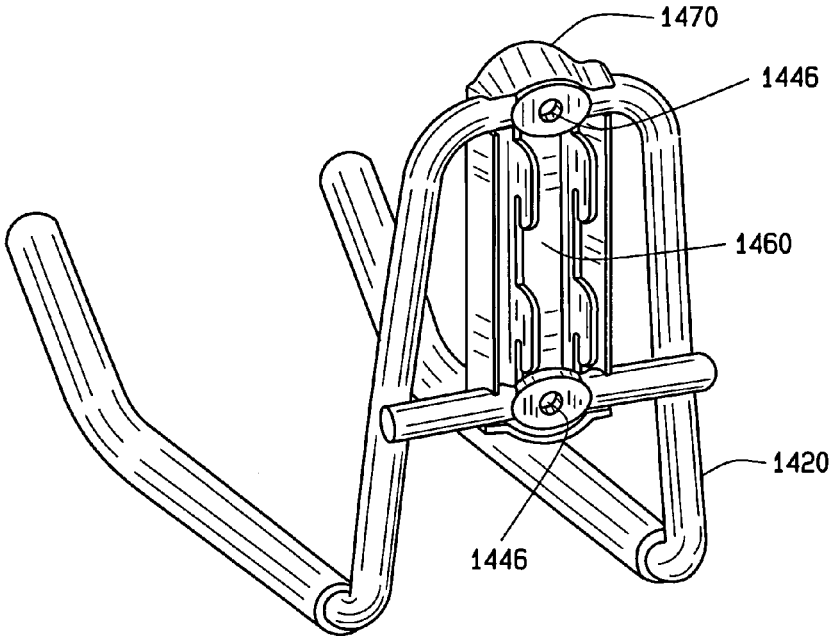
FIG. 42 is a back perspective view of the attachment member and hanger component shown in FIG. 37 and further illustrating a cover device according to another exemplary embodiment of the invention.
Figure 43:
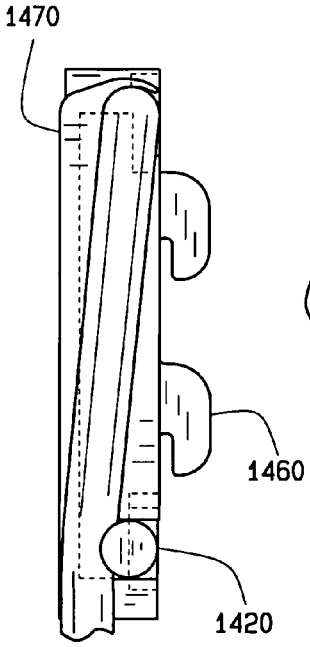
FIG. 43 is a side elevation view of the attachment member, cover device and a portion of the hanger component shown in FIG. 42.
Figure 44:
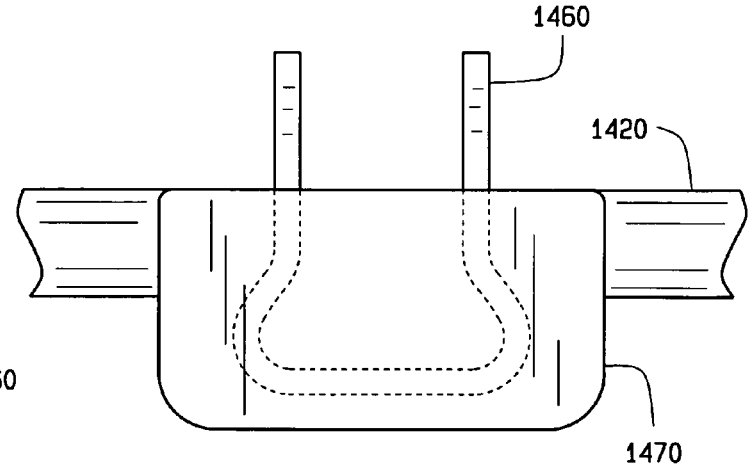
FIG. 44 is a top plan view of the attachment member, cover device and a portion of the hanger component shown in FIG. 42.

In various embodiments, the installed product can be trimmed off with a push-on or push-fit cover that hides the mounting hardware (e.g., screws, boss feature, attachment member, mechanical fasteners, etc.). The trim cover can also provide a suitable surface for displaying indicia, such as one or more advertisements, trademarks, trade names, service marks, graphic images, graphic elements, designs, artwork, distinctive marks, identifying symbols, company logos, company contact information, text, alphanumeric characters, sports team insignias, names, monograms, photographs, among others. In some embodiments, the outer surface portion of the cover may include integrally formed (e.g., integrally molded, etched, carved, etc.) indicia thereon. Alternatively, the outer surface portion of the cover may simply provide an area that is conducive for printing and/or adhesively affixing a label thereto. Accordingly, various embodiments can provide an end product having an improved finished look, which can also accommodate company branding (or other indicia displaying) and find greater utility in more areas of the home, office, or other place of use. By way of example, FIGS. 42 through 44 illustrate an exemplary cover device 1470 being used with the attachment device 1460 and hanger component 1420.

In other aspects, the invention provides methods for mounting hook or hanger components. In one exemplary embodiment, a method generally includes positioning at least one wire portion of a hook/hanger component relative to an attachment member and engaging the attachment member to a support surface (e.g., a wall standard, track standard, track mount or carrier, apertured surface, etc.) such that the at least one wire portion is operatively trapped between the attachment member and the support surface, thereby mounting the hanger component to the support surface.

In another embodiment, a method generally includes mounting at least one hanger component having two spaced-apart wire portions with an attachment member having two spaced-apart recessed portions. The method includes positioning the two spaced-apart wire portions of the hanger component relative to the recessed portions of the attachment member, and engaging the attachment member with a wall standard (or other support surface) such that the two spaced-apart wire portions of the hanger component are operatively trapped between the recessed portions of the attachment member and the wall standard.

Various aspects of the invention can be used with a wide range of wall standards, tracks, apertured panels or support surfaces, hooks, and hanger components. Accordingly, the specific references to wall standards, hooks, and hanger components should not be construed as limiting the scope of the invention to only one specific form/type of standard, hook, or hanger component. Further, the particular methods of manufacture and geometries disclosed herein are exemplary in nature and are not to be considered limiting. The steps, processes, and operations described herein are not to be construed as necessarily requiring their performance in the particular order discussed or illustrated, unless specifically identified as an order or performance. It is also to be understood that additional or alternative steps may be employed. In addition, any one or more aspects of the invention may be implemented individually or in any combination with any one or more of the other aspects of the invention.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system comprising an apertured support surface, a hanger component having generally parallel spaced-apart crossbar portions, an attachment member having one or more tabs configured to be engaged within one or more apertures of the apertured support surface, the attachment member including an upper portion and a lower portion, the upper portion having a first recessed portion configured for trapping one of the crossbar portions between the apertured support surface and the attachment member, and the lower portion having a second recessed portion configured for trapping the other one of said crossbar portions between the apertured support surface and the attachment member, to thereby retain the hanger component to the apertured support surface, wherein the crossbar portions include tapered sections tapering to reduced width portions configured to be received within the recessed portions of the attachment member, wherein at least one of said reduced width portions includes at least one opening therethrough for receiving at least one fastener for allowing the hanger component to be secured to a support surface with the fastener.

2. The system of claim 1, wherein at least one of the crossbar portions is trapped substantially against a front surface of the apertured support surface by at least one surface of at least one of said first and second recessed portions.

3. The system of claim 1, wherein contact between the tapered sections and the attachment member inhibits horizontal movement of the hanger component relative to the attachment member when the attachment member is engaged with the apertured support surface and retaining the hanger component to the apertured support surface.

4. The system of claim 1, wherein at least one of the reduced width portions includes a substantially flat back surface flush with a tangent surface of the corresponding crossbar portion, thereby allowing the reduced width portion to lie substantially flush against a correspondingly flat support surface.

5. The system of claim 1, wherein the crossbar portions are an integral part of a single bar being formed to include at least two generally parallel spaced-apart sections.

6. The system of claim 1, wherein the hanger component includes a first bar portion having end portions extending to form a pair of hooks for supporting one or more items thereon, and a second bar portion having end portions in contact with the first bar portion.

7. A system comprising an apertured support surface, a hanger component having generally parallel spaced-apart crossbar portions, an attachment member having one or more tabs configured to be engaged within one or more apertures of the apertured support surface, the attachment member including an upper portion and a lower portion, the upper portion having a first recessed portion configured for trapping one of the crossbar portions between the apertured support surface and the attachment member, and the lower portion having a second recessed portion configured for trapping the other one of said crossbar portions between the apertured support surface and the attachment member, to thereby retain the hanger component to the apertured support surface, wherein the crossbar portions include tapered sections tapering to reduced width portions configured to be received within the recessed portions of the attachment member, wherein at least one of said reduced width portions includes a substantially flat back surface flush with a tangent surface of the corresponding crossbar portion, thereby allowing the reduced width portion to lie substantially flush against a correspondingly flat support surface.

8. The system of claim 7, wherein the attachment member comprises a generally C-shaped channel with spaced-apart side walls having tabs for engaging apertures of the apertured support surface.

9. The system of claim 8, wherein a notch is defined between each said tab and the corresponding side wall, the notch configured to receive a portion of the apertured support surface such that engagement of the notches with the apertured support surface establishes a frictional fit of the crossbar portions between the attachment member and the apertured support surface.

10. The system of claim 7, wherein contact between the tapered sections and the attachment member inhibits horizontal movement of the hanger component relative to the attachment member when the attachment member is engaged with the apertured support surface and retaining the hanger component to the apertured support surface.

11. The system of claim 7, wherein the crossbar portions are an integral part of a single bar.

12. The system of claim 7, wherein at least one of the crossbar portions includes at least one end portion extending to form at least one hook for supporting one or more items thereon.

13. The system of claim 7, wherein the apertured support surface comprises a front surface of a wall standard, and wherein the attachment member's tabs are engagable to the apertures of the wall standard such that the attachment member's recessed portions trap the crossbar portions between the wall standard's front surface and the attachment member, thereby retaining the hanger component to the wall standard.

14. The system of claim 7, wherein at least one of the crossbar portions is trapped substantially against a front surface of the apertured support surface by at least one surface of at least one of said first and second recessed portions.

* * * * *